US007213654B2

(12) United States Patent
Plucheck et al.

(10) Patent No.: US 7,213,654 B2
(45) Date of Patent: May 8, 2007

(54) APPARATUS AND METHODS TO COMPLETE WELLBORE JUNCTIONS

(75) Inventors: Clayton Plucheck, Tomball, TX (US); Pat Williamson, Kingwood, TX (US); David Haugen, League City, TX (US); Doug Durst, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 137 days.

(21) Appl. No.: 10/703,397

(22) Filed: Nov. 7, 2003

(65) Prior Publication Data

US 2004/0159435 A1 Aug. 19, 2004

Related U.S. Application Data

(60) Provisional application No. 60/424,455, filed on Nov. 7, 2002.

(51) Int. Cl.
*E21B 19/16* (2006.01)
*E21B 23/13* (2006.01)
*E21B 43/14* (2006.01)

(52) U.S. Cl. ..... 166/380; 166/50; 166/117.5; 166/227; 166/384

(58) Field of Classification Search ..... None
See application file for complete search history.

(56) References Cited

U.S. PATENT DOCUMENTS

| | | | |
|---|---|---|---|
| 2,397,070 | A | 3/1946 | Zublin |
| 2,452,920 | A | 11/1948 | Gilbert |
| 2,797,893 | A | 7/1957 | McCune et al. |
| 2,858,107 | A | 10/1958 | Colmerauer |
| 3,330,349 | A | 7/1967 | Owsley et al. |
| 4,396,075 | A | 8/1983 | Wood et al. |
| 4,402,551 | A | 9/1983 | Wood et al. |
| 4,415,205 | A | 11/1983 | Rehm et al. |
| 4,436,165 | A | 3/1984 | Emery |
| 4,444,276 | A | 4/1984 | Peterson, Jr. |
| 4,573,541 | A | 3/1986 | Josse et al. |
| 4,577,388 | A | 3/1986 | Wood |
| 4,630,676 | A | 12/1986 | Long, Jr. |

(Continued)

FOREIGN PATENT DOCUMENTS

| | | |
|---|---|---|
| AU | 40168/93 | 12/1993 |

(Continued)

OTHER PUBLICATIONS

GB Search Report, Application No. GB 0326054.4, dated Jan. 29, 2004.

(Continued)

*Primary Examiner*—Zakiya W. Bates
(74) *Attorney, Agent, or Firm*—Patterson & Sheridan, L.L.P.

(57) ABSTRACT

A method and apparatus for completing a wellbore junction, wherein, in one embodiment, a first leg of a screen is fastened within a first tubular with a preformed window. The first tubular houses a whipstock with a cut-out portion containing a folded second leg of the screen. The first tubular is lowered into a junction of a central and a lateral wellbore. A second tubular is lowered within the first tubular and catches an end of the folded second leg of the screen thereby unfolding and expanding the screen as the second tubular is guided into the lateral wellbore.

39 Claims, 28 Drawing Sheets

U.S. PATENT DOCUMENTS

| | | | | |
|---|---|---|---|---|
| 4,648,454 | A | 3/1987 | Yarnell | |
| 4,701,988 | A | 10/1987 | Wood | |
| 4,807,704 | A | 2/1989 | Hsu et al. | |
| 5,289,876 | A | 3/1994 | Graham | |
| 5,301,760 | A | 4/1994 | Graham | |
| 5,318,122 | A | 6/1994 | Murray et al. | |
| 5,337,808 | A | 8/1994 | Graham | |
| 5,474,131 | A | 12/1995 | Jordan, Jr. et al. | |
| 5,477,925 | A | 12/1995 | Trahan et al. | |
| 5,526,880 | A | 6/1996 | Jordan, Jr. et al. | |
| 5,803,176 | A | 9/1998 | Blizzard, Jr. et al. | 166/298 |
| 5,833,003 | A | 11/1998 | Longbottom et al. | |
| 6,012,526 | A | 1/2000 | Jennings et al. | |
| 6,070,671 | A | 6/2000 | Cumming et al. | 166/381 |
| 6,135,208 | A | 10/2000 | Gano et al. | 166/313 |
| 6,209,644 | B1 | 4/2001 | Brunet | 166/297 |
| 6,253,846 | B1 | 7/2001 | Nazzai et al. | 166/242.2 |
| 6,279,659 | B1 | 8/2001 | Brunet | 166/313 |
| 6,325,148 | B1 | 12/2001 | Trahan et al. | 166/297 |
| 6,354,375 | B1 * | 3/2002 | Dewey | 166/313 |
| 6,374,918 | B2 | 4/2002 | Roberts et al. | 166/387 |
| 6,419,026 | B1 * | 7/2002 | MacKenzie et al. | 166/381 |
| 6,454,013 | B1 | 9/2002 | Metcalfe | 166/382 |
| 6,536,525 | B1 | 3/2003 | Haugen et al. | 166/297 |
| 6,547,006 | B1 | 4/2003 | Kuck et al. | 166/298 |
| 6,578,630 | B2 | 6/2003 | Simpson et al. | 166/55.8 |

FOREIGN PATENT DOCUMENTS

| | | |
|---|---|---|
| EP | 0 819 823 A3 | 1/1998 |
| GB | 2 357 099 | 6/2001 |
| WO | WO 1 501 504 | 2/1978 |
| WO | WO 2 282 835 | 4/1995 |
| WO | WO 2 297 779 | 8/1996 |
| WO | WO 2 304 764 | 3/1997 |

OTHER PUBLICATIONS

GB Combined Search and Examination Report, Application No. GB 0326054.4, dated Jan. 30, 2004.

* cited by examiner

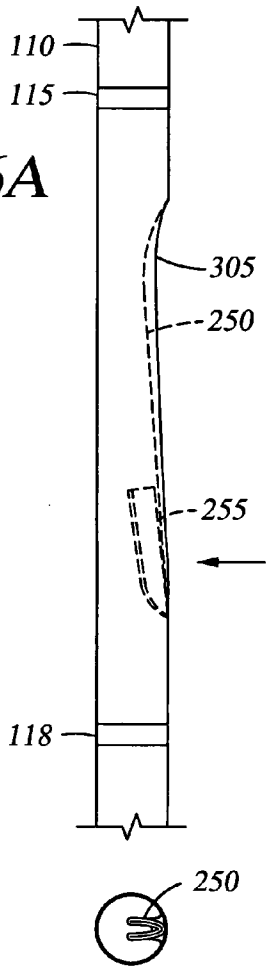
Fig. 6A
Fig. 6B
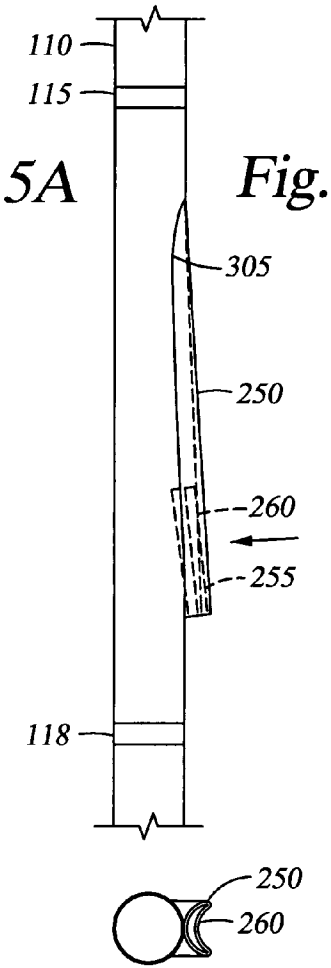
Fig. 5A
Fig. 5B
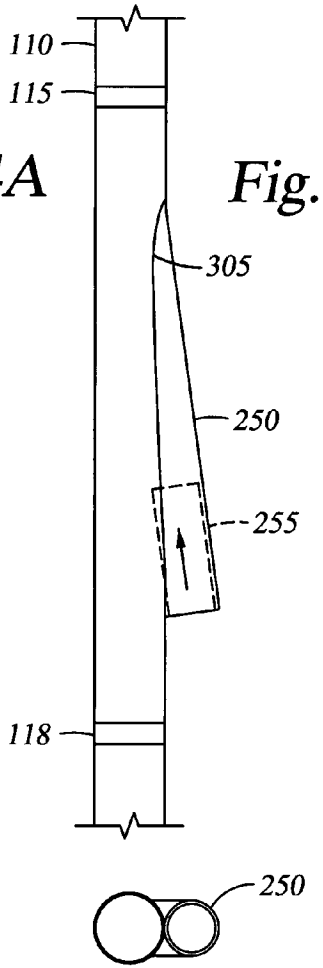
Fig. 4A
Fig. 4B
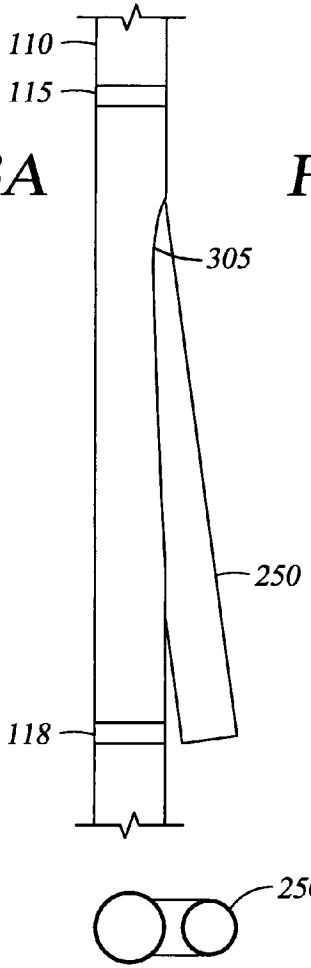
Fig. 3A
Fig. 3B

APPARATUS AND METHODS TO COMPLETE WELLBORE JUNCTIONS

CROSS-REFERENCE TO RELATED APPLICATIONS

This application claims benefit of U.S. provisional patent application Ser. No. 60/424,455, filed Nov. 7, 2002, which is herein incorporated by reference.

BACKGROUND OF THE INVENTION

1. Field of the Invention

The present invention relates to methods for completing wells, such as hydrocarbon and water wells. Particularly, the present invention relates to junctions in multilateral wellbores. More particularly, the invention relates to an apparatus and methods for forming and completing junctions, especially junctions designed for solids exclusion.

2. Description of the Related Art

Hydrocarbon wells are typically formed with a central wellbore that is supported by steel casing. The steel casing lines the borehole formed in the earth during the drilling process. This creates an annular area between the casing and the borehole, which is filled with cement to further support and form the wellbore.

Some wells are produced by perforating the casing of the wellbore at selected depths where hydrocarbons are found. Hydrocarbons migrate from the formation, through the perforations, and into the cased wellbore. In some instances, a lower portion of a wellbore is left open, that is, it is not lined with casing. This is known as an open hole completion. In that instance, hydrocarbons in an adjacent earth formation migrate directly into the wellbore where they are subsequently raised to the surface, typically through an artificial lift system.

Junctions between wellbores are commonplace and are useful to reduce costs associated with drilling, to more completely access a formation and to permit multiple formations to be accessed from a single central wellbore. Typically, a lateral wellbore is formed from a central wellbore at some predetermined location with the use of a whipstock or some other type of diverter. The lateral wellbore may be formed along with the central wellbore or it may be formed at a later time when the need arises to access some other formation or some other portion of a formation already being produced. When lateral wellbores are drilled from an existing, cased wellbore, a window is formed in a wall of the casing by milling and then the lateral wellbore is drilled through the window.

However the lateral wellbore is formed, the junction between it and the central wellbore becomes a critical part of the well. In some instances, the lateral wellbore is left unlined and a tubular string is inserted therein to transport wellbore fluids. In other cases, a screen type tubular is inserted into the wellbore to collect fluids that migrate from a surrounding formation. In still other cases, the lateral wellbore is lined with a tubular that is centered in place and perforated at some point to permit the introduction of hydrocarbons. In some cases, it is important to hydraulically isolate a lateral wellbore from the central wellbore. Towards this end, hardware has been developed that is insertable into the area of the junction with tubular members that provide connection means for tubulars running up and down the central wellbore and running out into the lateral wellbore. Through the use of packers and seals, the wellbores can be "plumbed" (or "plugged") in a variety of ways that prevent the co-mingling of fluids between wellbores or portions of the wellbores. A variety of completion options are employed, including the use of a shared production string for delivering production from producing zones in both the primary and lateral wellbores to the surface. Alternatively, separate production tubulars may be used. In any event, it is oftentimes desirable to place sand screens at the actual zones of production in the primary and lateral wellbores.

Because of their complexity, these junction-lining devices are very expensive to manufacture and their insertion into a wellbore is complex. More importantly, it is not always necessary or even desirable to utilize a device in a wellbore junction that prevents commingling of fluids. Sometimes, the only need is provide some type of structure that will enhance the strength of the junction while not reducing the internal diameter of the wellbores. For example, junctions that are left completely unlined are more likely to suffer cave in or be adversely affected by pressure spikes from one of the wellbores or from a surrounding formation. Additionally, unlined wellbores have no means to prevent solids from entering the junction and interfering with the production of liquid hydrocarbons. In that respect, an open hole leaves aggregate material, including sand, free to invade the wellbore.

Sand production can result in premature failure of artificial lift and other downhole and surface equipment. Sand can build up in the borehole and tubing to obstruct fluid flow. Particles can compact and erode surrounding formations to cause liner and casing failures. In addition, produced sand becomes difficult to handle and dispose of at the surface. Ultimately, open holes carry the risk of complete collapse of the formation into the wellbore.

Heretofore, gravel packs have been utilized in wells to preserve the integrity of the formed borehole, and to prevent the production of formation sand. In gravel packing operations, a pack of gravel, e.g., graded sand, is placed in the annulus between a perforated or slotted liner or screen and the walls of the wellbore in the producing interval. The resulting structure provides a barrier to migrating sand from the producing formation while allowing the flow of produced fluids.

While gravel packs inhibit the production of sand with formation fluids, they often fail and require replacement due, for example, to the deterioration of the perforated or slotted liner or screen as a result of corrosion or the like. In addition, the initial installation of a gravel pack adds considerable expense to the cost of completing a well. The removal and replacement of a failed gravel pack is even more costly.

To better control particle flow from unconsolidated formations, an improved form of well screen has been recently developed. The well screen is known as an expandable sand screen, or "ESS tool." The ESS is run into the wellbore at the lower end of a liner string and is expanded into engagement with the surrounding formation, thereby obviating the need for a separate gravel pack. In general, the ESS is constructed from three composite layers, including a perforated base pipe, a protective, slotted outer shroud, and an intermediate filter media. The filter media allows hydrocarbons to invade the wellbore, but filters sand and other unwanted particles from entering. Both the base pipe and the outer shroud are expandable, with the woven filter being arranged over the base pipe in sheets that partially cover one another and slide across one another as the sand screen is expanded.

The issues related to unlined junctions are most critical during the time a lateral wellbore is being drilled; long before a conventional junction support could be installed. An operator may want to produce fluids from a formation adjacent the wellbore junction and it is therefore desirable to permit fluids to pass into the wellbore at the junction. However, known hardware used to form the junction is comprised of solid metal materials. Thus, production from the formation at the point of the junction itself has heretofore been impossible. Additionally, it is not unusual to produce from a single formation that is intersected by both the central and lateral wellbores. In these cases, there is no reason to prevent co-mingling of the fluids between the wellbores. Finally, there are instances when cemented junctions become brittle or are damaged by pressure differentials. In these instances, some type of support placed in the junction prior to cementing could serve as a reinforcement of the cement and provide a longer lasting more robust junction.

A further benefit may be gained from using perforated junction hardware even if production from the junction is not desired. Fluid permeable junction hardware will not have to sustain high external formation pressure or contain high internal pressure which could damage solid junction hardware.

Accordingly, a need exists for a method and apparatus for completing a wellbore wherein support is provided for the junction in a multilateral wellbore. Further, a need exists for junction hardware that is not fluid sealed. Still further, a need exists for a junction fabricated from an expandable sand screen so as to prevent sand from entering the production string or otherwise traveling to the surface and being produced.

SUMMARY OF THE INVENTION

The present invention provides methods and apparatus to complete a junction between two wellbores in a hydrocarbon well. In one aspect of the invention, a junction between a central and lateral wellbore is at least partially lined with a material that prevents solids from migrating into the wellbores but permits fluids to pass therethrough. In another aspect, the junction is lined with a screen-type material to retain strength while the wellbores are completed. In another aspect, the screen-like material provides reinforcement to cement when a junction between wellbores is cemented for hydraulic isolation.

In another aspect, central and lateral wellbores are drilled in the earth and thereafter, a string of casing is run into the central wellbore having a section therein which includes a preformed window having screen material covering the window. A pre-inserted whipstock adjacent the window permits a liner to be inserted through the window and into the lateral wellbore. As the liner moves through the window, screen material is extended in a manner, which covers an upper portion of the liner and also the junction between the liner and the window. In a second embodiment of the invention, a portion of a central wellbore adjacent a location for drilling a lateral wellbore is under-reamed to produce an enlarged diameter portion of the wellbore. Thereafter, a string of casing with a section having a preformed window with screen therein is lowered into the wellbore adjacent the under-reamed area. Utilizing the whipstock, a string of liner is inserted through the preformed window and, using an expandable drill, the lateral wellbore is formed and the liner is inserted. After formation of the lateral wellbore, the drill is either removed or remains at the end of the lateral wellbore.

In a third embodiment, the screen is run into the central wellbore on a string of tubulars to the junction. The screen is expanded against a wall of the central wellbore. The screen is extended into the lateral wellbore and expanded against the wall of the lateral wellbore.

In a fourth embodiment, a first screen is run into the central wellbore on a string of tubulars to the junction and extended or expanded against the wall of the central wellbore. A window is then formed by penetrating the first screen. A second screen is then run through the window into the lateral wellbore and extended or expanded against the wall of the lateral wellbore. The second screen may partially overlap the first screen.

In a fifth embodiment, a lateral wellbore is formed from an existing, cased central wellbore after a cylindrical section of screen is disposed across a window is formed by milling the casing wall. Thereafter, as with the previous embodiments of the invention, a liner is run-in to the lateral wellbore in a manner that extends the screen material along the outer portion of the liner, causing the screen material to cover the interface between the liner and the window.

In a sixth embodiment, the screen is placed into the junction according any previous embodiments and cemented into place.

In a seventh embodiment, a screen is run to the junction on an expandable tubular. The screen is expanded into the lateral wellbore as with previous embodiments. The tubular is then expanded thereby fixing the screen and tubular in the wellbore.

In an eighth embodiment, an expandable junction component is run into a junction and expanded into place. In one aspect, the component is constructed of a multi-layered sand screen material. In a second aspect, the component comprises a pre-formed central wellbore access port and is only partially expandable.

In a ninth embodiment, an expandable junction component is run into a lateral wellbore. In one aspect, the junction component is run in with expandable production tubing that may be sand screen. The junction component may just be one end of the expandable production tubing. The junction component and tubing are then expanded against the wall of the lateral wellbore. In a second aspect, the junction component is expanded into place and then conventional production tubing is run into the lateral wellbore and coupled to the junction component. In either aspect, a central wellbore access port may then be milled into the junction component.

In a tenth embodiment, a lateral wellbore is formed and lined according to the first aspect of the ninth embodiment. If necessary, a central wellbore access port is milled into the junction component. A production string has been lowered into the central wellbore with a packer. In one aspect, a sump pump is provided in the production string. Production may then be from the central wellbore while isolating the junction and the lateral wellbore. In a similar second aspect, the pump is replaced by a sleeve valve. Production may then be from a selection between just the central wellbore and commingled production from the central and lateral wellbores and the junction. In a third aspect, a production string is lowered into the central wellbore to a point just above the junction. Two sub-strings extend from the production string, one into the central wellbore below the junction and one into the lateral wellbore past the junction. The lateral sub-string is sealingly coupled to the expanded tubing already in place. Production may then be commingled from the central and lateral wellbores while isolating the junction. In a similar fourth aspect, each sub-string is a complete string to the surface. Production may then be separate from the lateral and central wellbores while isolating the junction. Alternatively, any of the previous aspects may be configured to add another production path by removing the packer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 3A–6B are schematic views of the screen portion of the casing illustrating the manner in which screen material in the window is folded and inserted into the casing prior to run-in.

FIG. 17 also shows an expandable drill bit forming a lateral wellbore.

FIG. 31 presents four cross-sectional views of a multilateral wellbore junction.

FIG. 32 presents four cross-sectional views of a multilateral wellbore junction.

DETAILED DESCRIPTION OF THE EMBODIMENT

Figure 1:
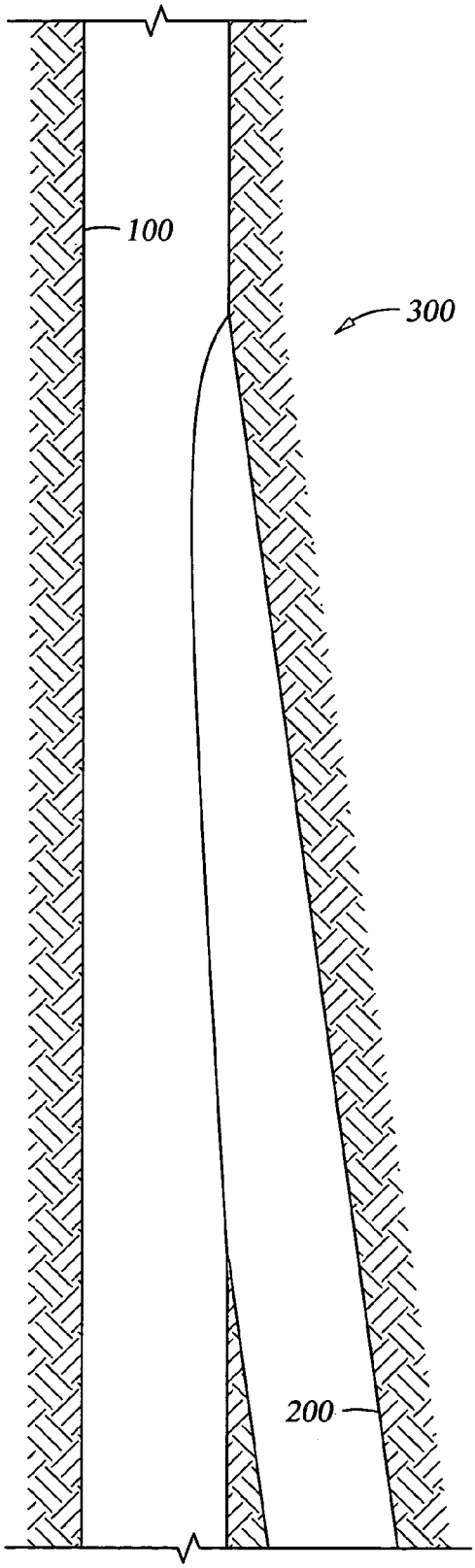
FIG. 1 is a section view showing a central wellbore with a lateral wellbore extending therefrom.

FIG. 1 is a section view showing a central wellbore 100 with a lateral wellbore 200 extending therefrom. Typically, the central wellbore 100 is formed and thereafter, using some whipstock or other diverter that is temporarily placed in the central wellbore 100, the lateral wellbore 200 is formed to more fully access a formation or to access a different formation adjacent the central wellbore 100. In this specification, the interface between the central wellbore and the lateral wellbore is considered a wellbore junction and that junction 300 is generally illustrated in FIG. 1.

Figure 2:
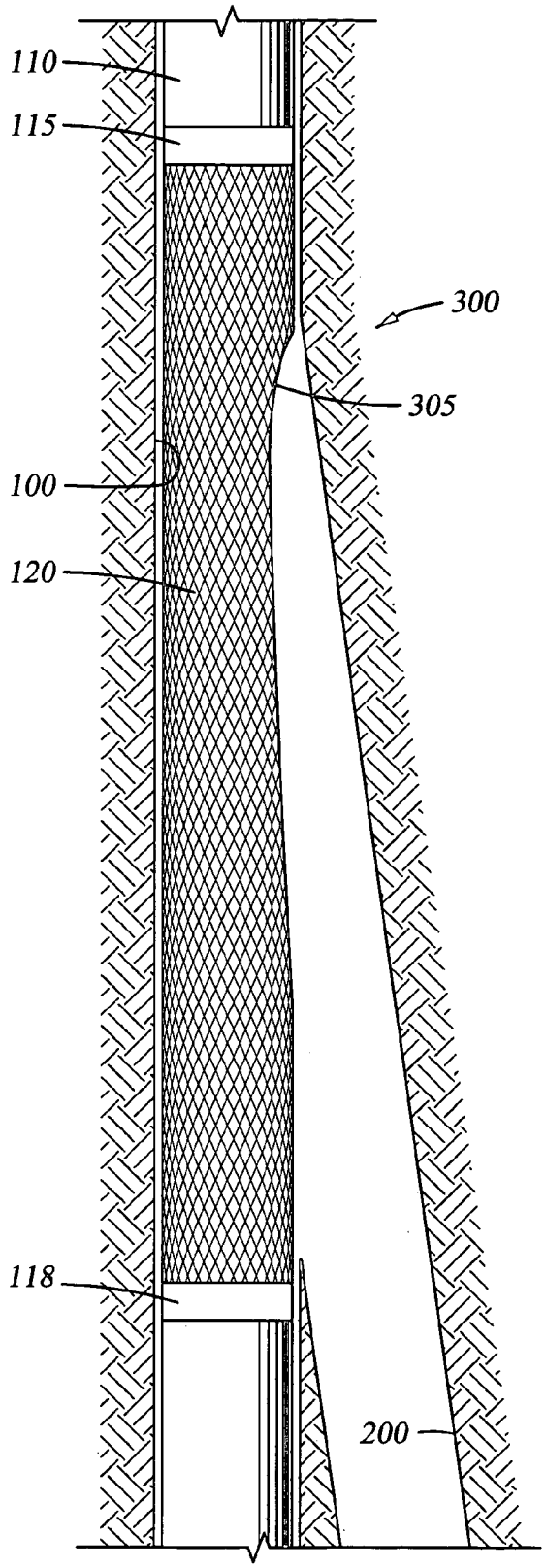
FIG. 2 is a section view of the central and lateral wellbores of FIG. 1 showing a casing with a screen section and a preformed window disposed in the central wellbore adjacent the lateral wellbore.

FIG. 2 is a section view illustrating the wellbore 100 with a string of casing 110 disposed therein. In the case of FIG. 2, the string of casing 110 includes a section, which includes screen material 120 disposed therein and held at each end by upper and lower rings 115, 118. Preformed in a wall of the casing 110 at junction 300 is a window 305 visible in profile in FIG. 2. The purpose of the screen material 120 disposed within the casing 110 is to insure that screen material 120 covers the preformed window 305 in order to provide means to exclude solids between the lateral wellbore 200 and the casing window 305, as will be discussed herein. Typically, the screen 120 is disposed within the casing 110 after the preformed window 305 has been formed and the screen 120 is then held tightly to the casing by the rings 115, 118. The screen material 120 is typically composed of at least one and more multiple layers of metallic, woven mesh and is sized in order to prevent the inflow of solid particles. In some instances, where the screen material 120 might be stretched, the material 120 may include a series of scaled filter sheets which are layered and include the compability of moving laterally in relation to each other without any significant loss of filtering capability. The outer surface of the screen material 120 may include a protective layer, wherein the filter and protective layer are sintered together. This results in a robust screen, 120 wherein the sieve size does not change significantly during or after deformation by stretching. After running the string of casing 110 into the central wellbore 100 and locating the window 305 adjacent the lateral wellbore 200, the string of casing 110 is typically held in the central wellbore 100 by some type of hanging means or by a separate string of tubulars extending to the surface of the well (not shown).

Alternatively, the screen 120 may be constructed from three layers, including a perforated base pipe, a protective, slotted outer shroud, and an intermediate filter media. The screen 120 would have rigidity like that of pipe and serve as the casing proximate the junction. The rings 115, 118 would then merely serve to couple the screen 120 to the casing 110. The window 305 would then be pre-formed in a wall of the multi-layered screen 120 instead of the casing 110. This multi-layered screen may also be expandable.

In order to insure that the interface between a string of liner and the window 305 is completely covered with screen 120, additional screen material may be provided in the area of the preformed window 305. The additional screen material will form a type of "pant-leg" 250 for a liner is illustrated in FIGS. 3A–6B. The pant-leg 250 may also comprise three layers. The pant-leg 250 will be folded and housed within the casing 110 at the surface prior to run-in. FIGS. 3A–6B illustrate that portion of the string of casing 110 that includes the screen material 120 and the preformed window 305. For clarity, the screen material 120 within the casing 110 is not illustrated but extends between the upper and lower rings 115, 118 as shown in FIG. 2. In addition to the screen material 120 within the casing 110, the additional screen material or pant-leg 250 is illustrated in FIG. 3A. FIG. 3B is a view of 3A taken from the bottom, illustrating the pant-leg 250 having a circular shape prior to installation into the casing 110. FIG. 3A illustrates the pant-leg 250 fully extended as it will appear in the lateral wellbore after the string of liner inserted through the window 305.

In order to prepare the pant-leg 250 portion of the screen material 120 for insertion into casing 110, the material is first folded upwards into a folding portion 255 as illustrated by the dotted line portion of the pant-leg 250 visible in FIG. 4A. After the folded portion 255 is formed, pant-leg 250 is folded, the bottom view of the assembly visible in FIG. 4B illustrates the relative proximity of the bottom of the pant-leg 250 to the casing 110. FIG. 5A illustrates additional manipulation of the cuff portion 255 of the pant-leg 250. Specifically, as illustrated in FIG. 5B, a bottom view of the assembly, the folded portion 255 is shaped into a crescent shape 260 as a center portion is urged inward in relation to the outer edges. Thereafter, the outer edges of the crescent shape 260 are manipulated inwards to a point where the pant-leg 250 is completely housed in the casing 110, as shown in FIG. 6A and FIG. 6B, a bottom view of the assembly illustrating the relative position of the screen material 120 relative to the casing 110.

Not shown in FIGS. 3A–6B is a whipstock which may be disposed in the casing 110 adjacent the preformed window 305 at the surface prior to folding the pant-leg 250. The whipstock includes a cut-out portion 275 (see FIG. 7) constructed and arranged to hold the folded portion 255 of the screen as the casing 110 is run into the wellbore. Specifically, the folded portion 255 is housed in the cut-out in order to avoid interfering with a string of liner as it run down the whipstock and through the casing window 305 as will be described herein.

Figure 7:
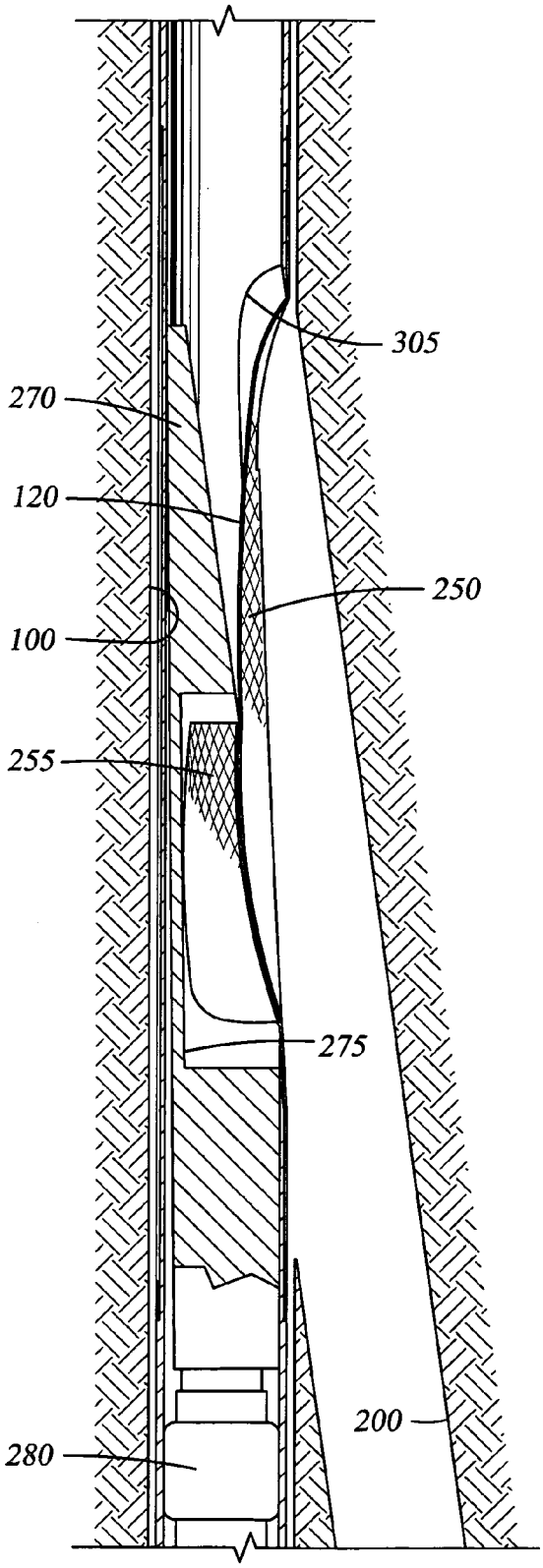
FIG. 7 is a section view of the central and lateral wellbores illustrating the interior of the screen section and showing a preinstalled whipstock disposed therein.

FIG. 7 is a partial section view of the central and lateral wellbores 100, 200 illustrating that section of casing 110 in the central wellbore 100 which includes the preformed window 305 and shows especially a whipstock 270 which is inserted in the casing 110 prior to run into the central wellbore 100 as well as a cut-out portion 275 of the whipstock which includes the folded portion 255 of the pant-leg 250. As discussed previously, the cut-out portion 275 serves as a housing for the folded portion 255 to prevent the folded portion 255 from interfering with use of the whipstock 270 when a string of liner is inserted into the lateral wellbore 200. Also visible in FIG. 7 is an anchor assembly 280 which is used to temporarily anchor the whipstock 270 in the casing 110 while a liner is run into the lateral wellbore 200.

Figure 8:
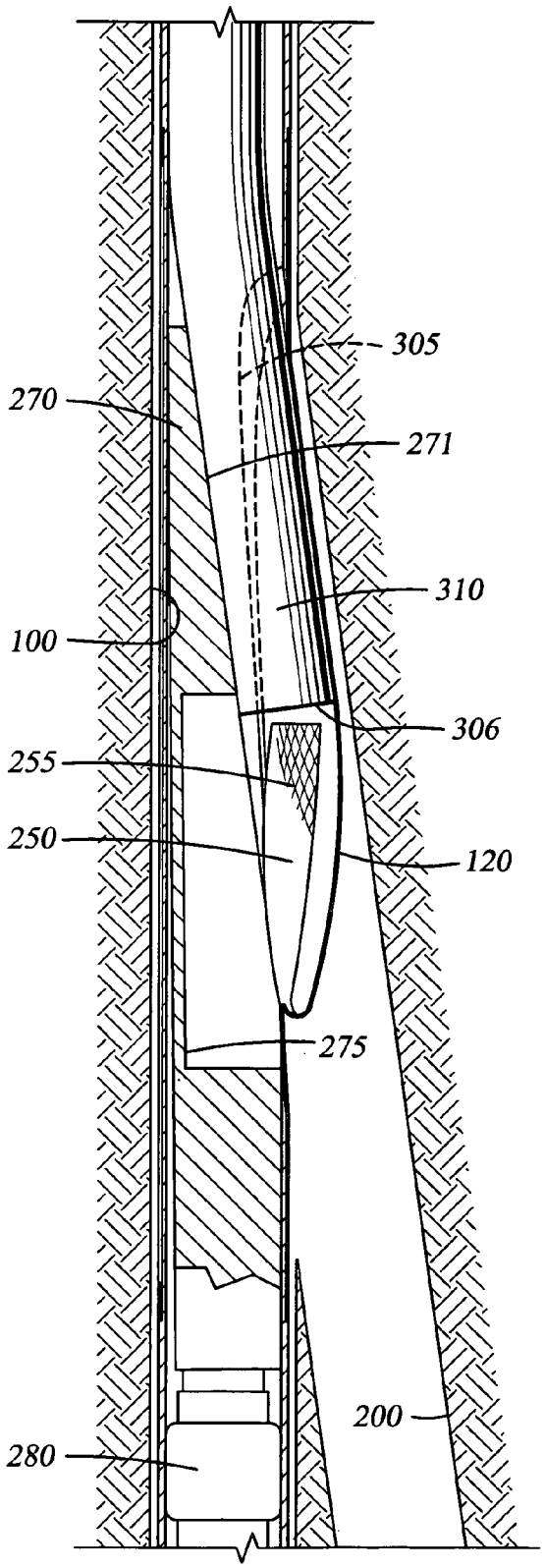
FIG. 8 is a section view of the central and lateral wellbores illustrating a liner partially inserted into the lateral wellbore via the whipstock.

FIG. 8 is a partial section view similar to FIG. 7 but illustrating a string of liner 310 partially run along an inclined surface 271 of the whipstock 270 and having made initial contact with the screen material 120. Visible specifically in FIG. 8 is the folded portion 255 of the pant-leg 250 as it is partially urged away from the cut-out portion 275 of the whipstock 270 by a leading edge 306 of the string of liner.

Figure 9A:
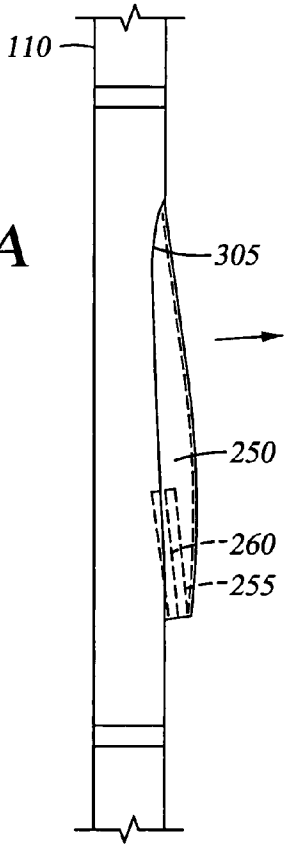
FIGS. 9A, B–11A, B are sketches illustrating the manner in which the screen material in the window interacts with the liner to extend into the lateral wellbore, covering the external surface of the liner.
Figure 9B:
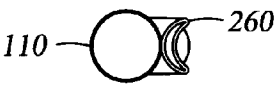

FIGS. 9A–11B illustrate the movement of the pant-leg 250 and the folded 255 portion of the screen as it is urged into an extended position in the lateral wellbore by the liner as the liner extends through the preformed casing window 305 and into the lateral wellbore. FIG. 9A and 9B correspond to FIG. 8, showing the folded portion 255 of the pant-leg 250 partially pushed through the window 305 formed in the casing 110. As shown in FIG. 9B, the folded portion 255 is in the crescent shape 260 as it begins to unfold.

Figure 11A:
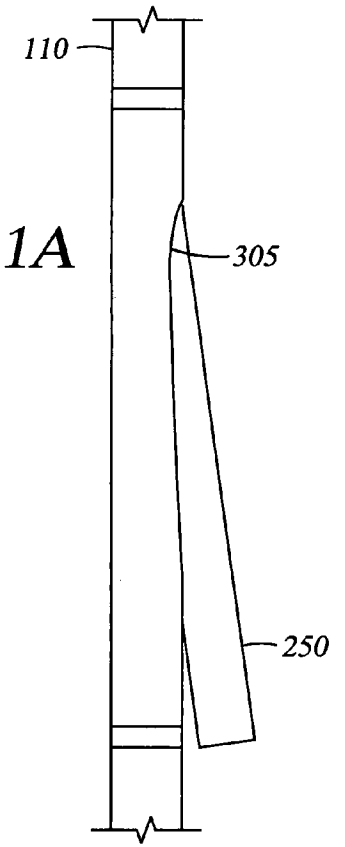
Figure 11B:
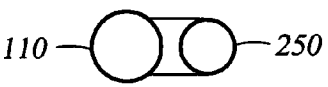
Figure 10A:
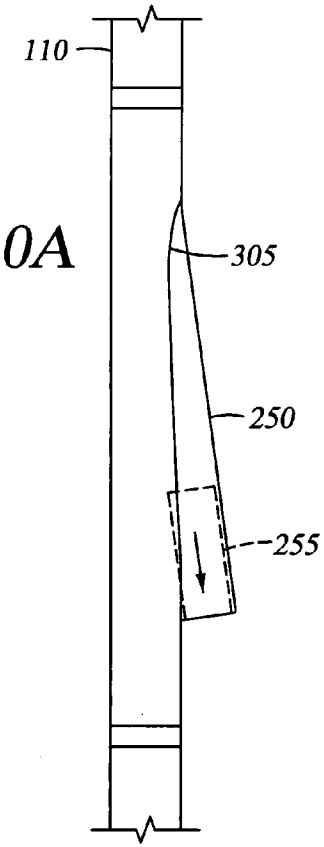

In FIGS. 10A, B, the pant-leg portion 250 is completely extended through the window 305 due to the insertion of the liner string and only the folded portion 255 remains. Finally, FIGS. 11A and 11B illustrate the pant-leg portion 250 completely extended as it would appear once the liner string has been completely inserted into the lateral wellbore.

Figure 10B:
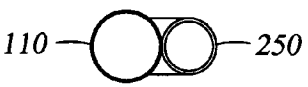
Figure 12:
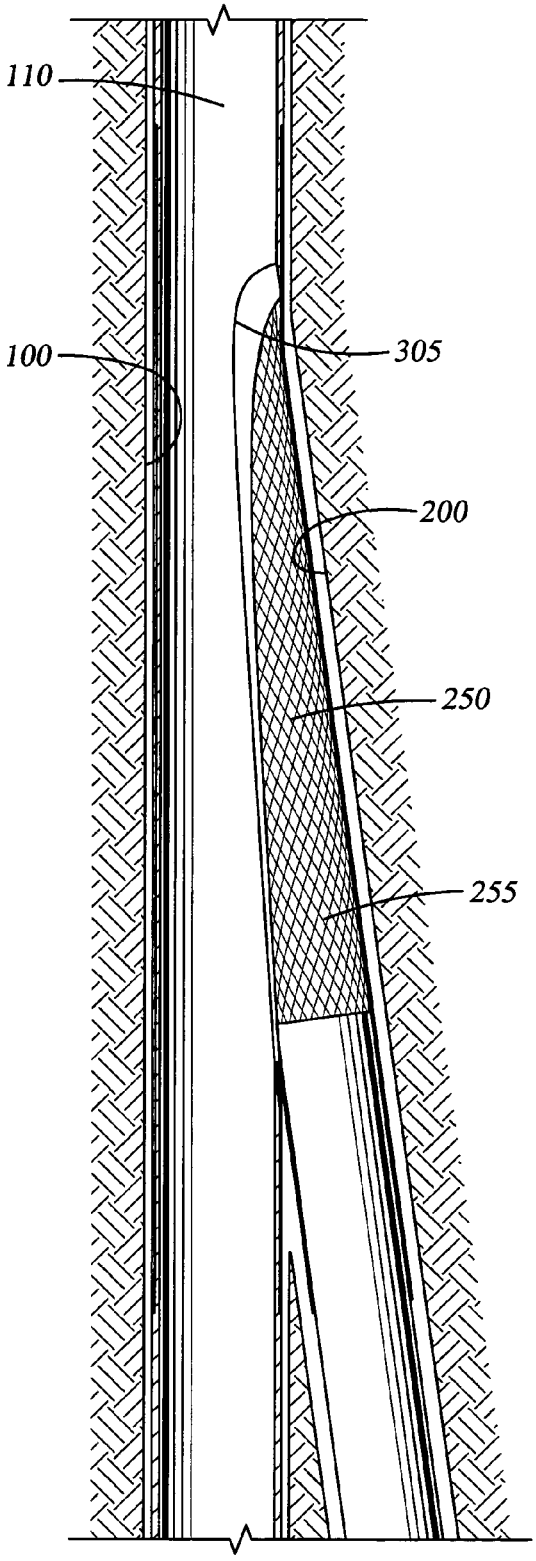
FIG. 12 is a partial section view illustrating the liner partially installed through the window of the casing.
Figure 13:
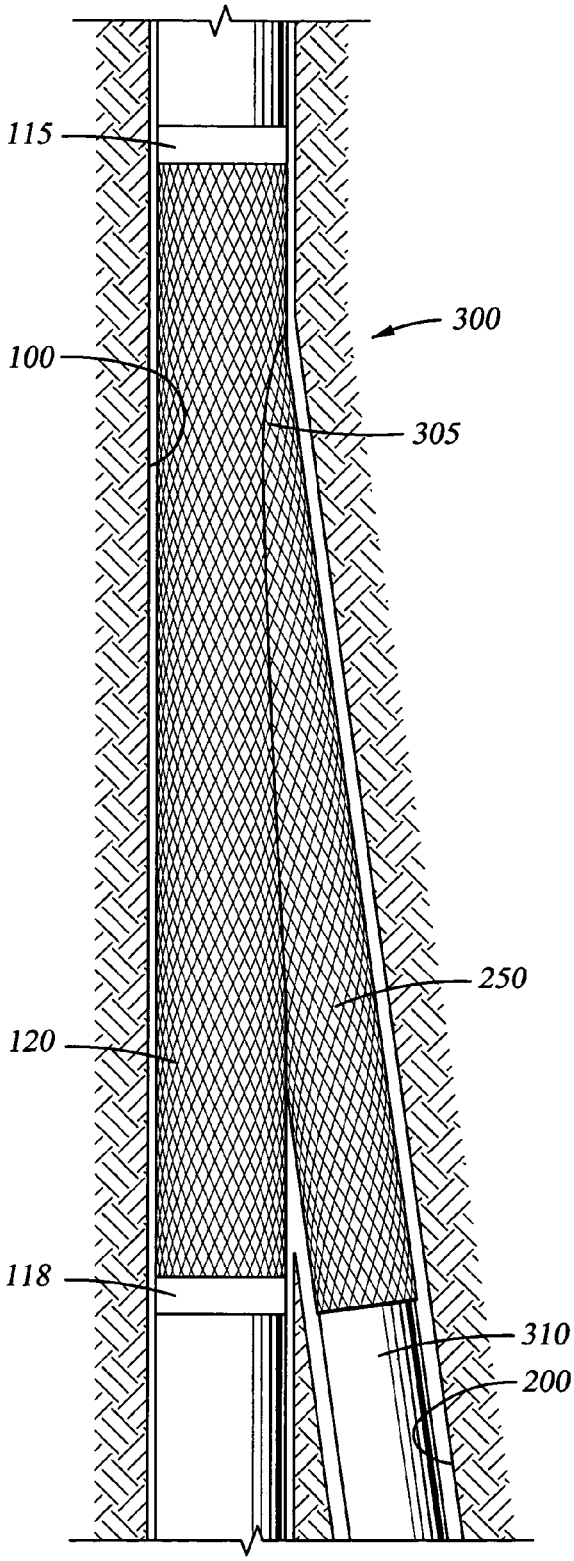
FIG. 13 is an elevation view showing the portion of the liner extending from the window completely covered with screen and the screen interface between the liner and the casing window.

FIG. 12 corresponds basically to FIGS. 10A and 10B and illustrates the pant-leg portion 250 of the screen extended out into the lateral wellbore 200 but with the folded portion 255 still remaining folded within. The whipstock is no longer visible in the central wellbore 100 and typically would have been removed. In FIG. 13, an elevation view of the central 100 and lateral 200 wellbores the pant-leg 250 is shown fully extended as it appears after the string of liner 310 has been completely inserted. Visible specifically in FIG. 13 is the interface or junction 300 between casing window 305 and the string of liner 310 in the lateral wellbore 200. As is apparent from FIG. 13, the junction 300 is now completely sealed with the screen material 120 and while fluids may pass through, the passage of solids is effectively blocked depending upon the characteristics of the screen material 120.

Figure 14:
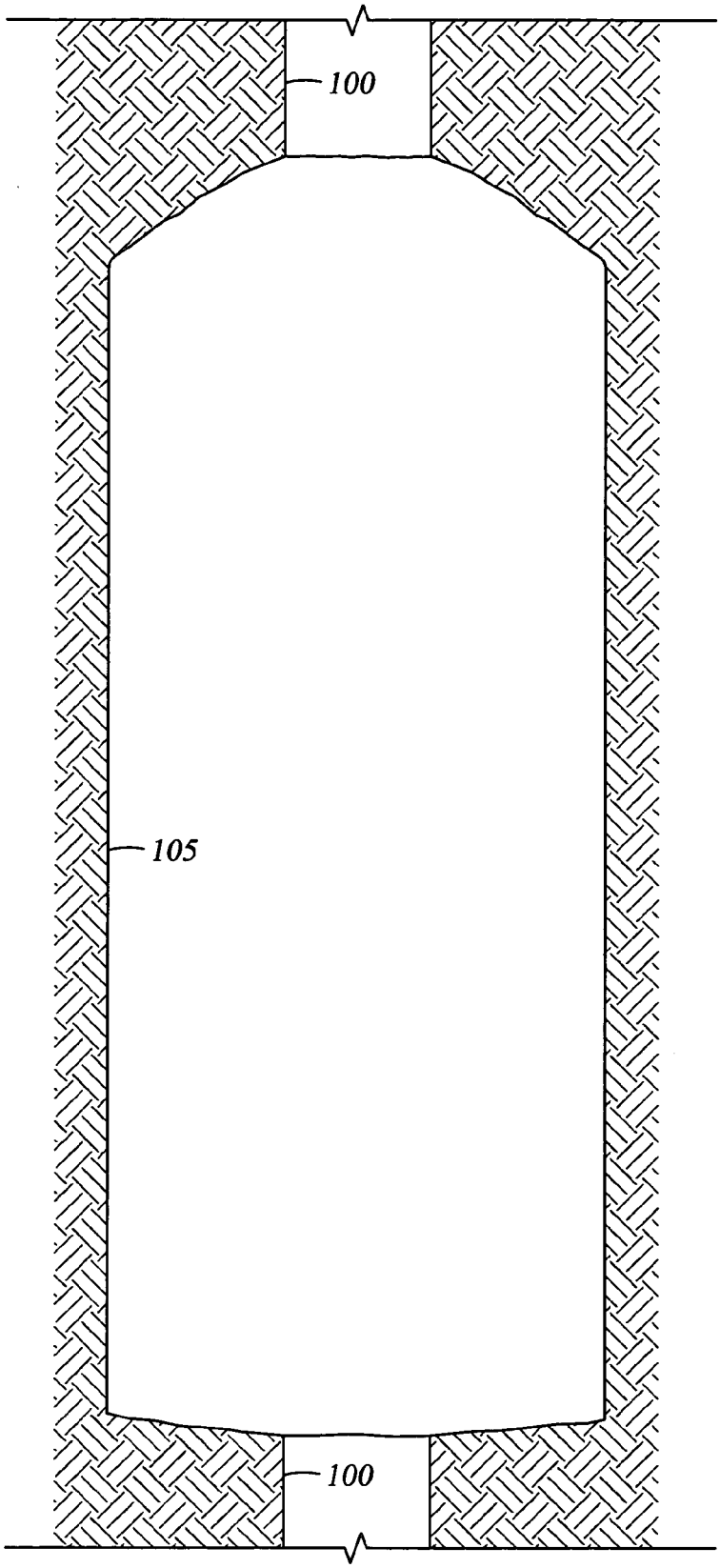
FIG. 14 is a section view of a wellbore including a central wellbore having an enlarged diameter portion.
Figure 15:
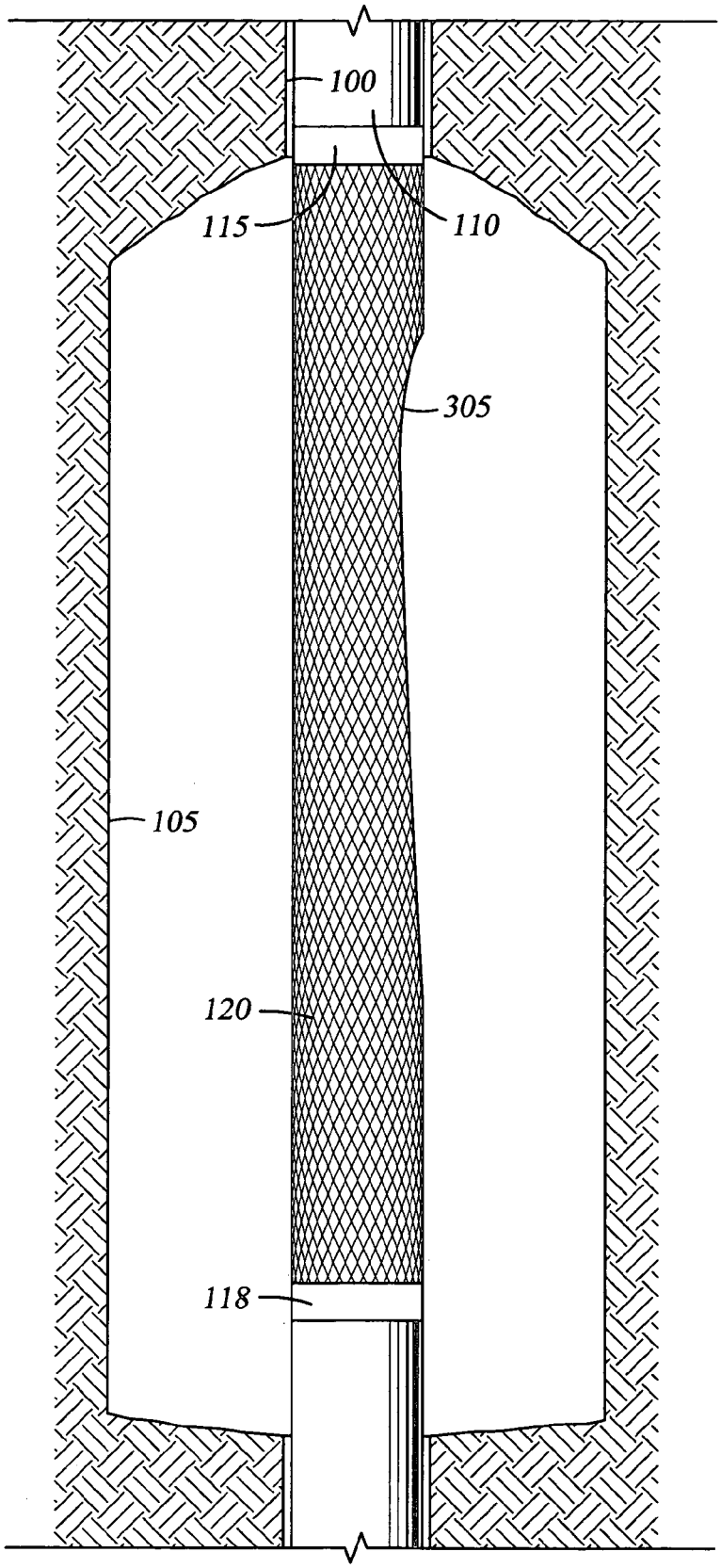
FIG. 15 is a partial section view of the wellbore of FIG. 14 illustrating a string of casing inserted in the wellbore with a preformed window formed in the casing and screen material wrapped around the casing at the location of the window.

In another embodiment of the invention, a lateral wellbore is formed through a window having a screen portion like the one previously described. FIG. 14 illustrates a central wellbore 100 with an enlarged diameter portion 105 formed therein. Typically, the larger diameter portion is formed with an under reamer (not shown) that includes some type of extendable blade members that can be selectively extended to enlarge the diameter of a section of wellbore. The purpose of the enlarged diameter portion 105, as will be explained herein, is to permit a liner string (not shown) to be at least partially inserted through a casing window (not shown) prior to the formation of a lateral wellbore. FIG. 15 is a partial section view of the wellbore of FIG. 14 showing the string of casing 110 installed into the central wellbore 100 and having the preformed window 305 in a wall thereof. In FIG. 15 the window 305 is visible in profile. Also included in the casing string 110 adjacent the window 305 is a pre-located whipstock (not shown) that will be used to run a string of liner (not shown) through the window 305. Additionally, as with the previous embodiment, the screen portion 120 is disposed within the casing 110 and held by rings 115, 118 at an upper and lower end. As with the previous embodiment, also included is a pant leg portion (not visible) of the screen 120 that is initially housed in a cut-out portion of the whipstock (see FIGS. 3A–6B).

Figure 16:
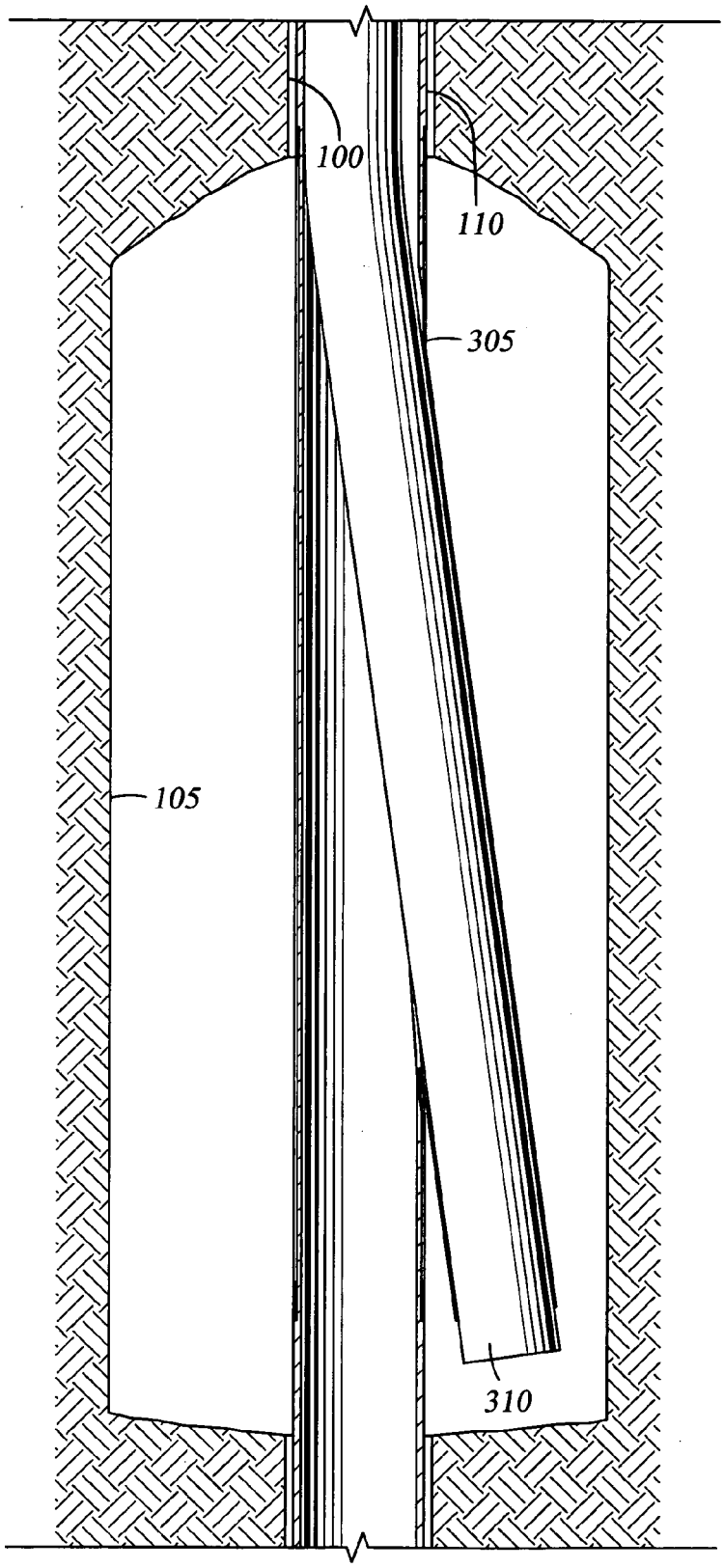
FIG. 16 is a partial section view of the wellbore after a string of liner has been extended through the casing window.

FIG. 16 is a section view that shows the liner string 310 being inserted through the window 305 and into the enlarged diameter area 105 of the wellbore. As with the previous embodiments, the movement of the liner string 310 along an inclined surface of the whipstock causes a folded portion of the pant leg to straighten out and the pant leg to be carried towards that portion of the wellbore from which the lateral wellbore will extend.

Figure 17:
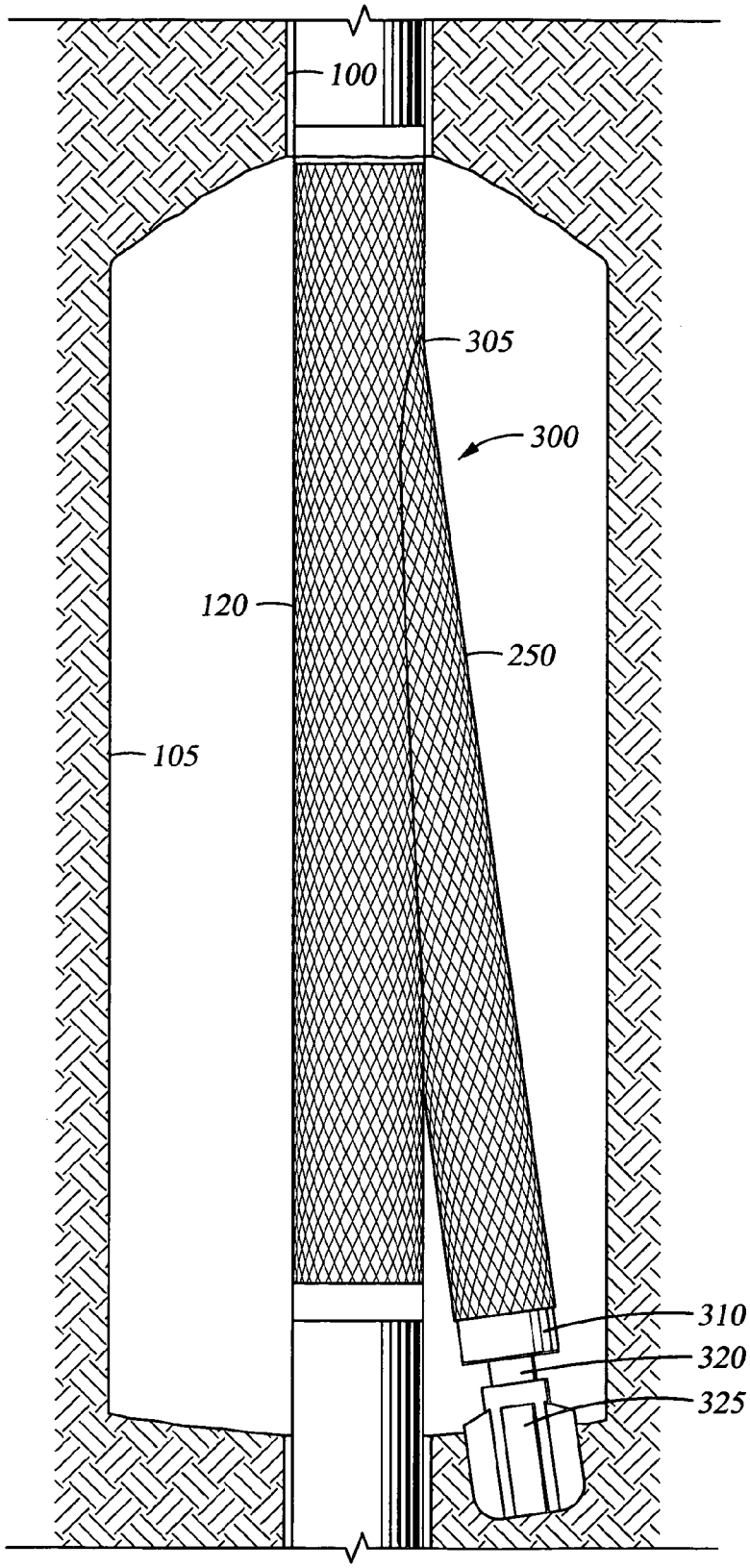
FIG. 17 is a partial section view illustrating the liner string extending through the window and showing the interface between the liner and the casing window completely covered with screen material.

FIG. 17 is a partial section view showing the liner 310 extended completely through the window 305 to a point wherein the pant leg portion 250 of the screen is completely extended and the interface or junction 300 between the liner 310 and the window 305 formed in the casing 110 wall is completely covered with the screen material 120. At a lower end of the liner 310 is a separate string of drilling tubulars 320 and a bit 325 disposed at the end thereof. In the preferred embodiment, the bit 325 is initially fixed and housed within the end of the liner string 310. After the end of the liner 310 has been inserted through the casing window 305 and into the enlarged diameter portion 105 of the central wellbore 100, the bit 325 is remotely disconnected from the liner 310 and can be moved axially with respect to the liner 310. Additionally, with the use of a mud motor (not shown) or other device that can transfer fluid flow to rotational movement, the drill can be rotated to form the lateral wellbore. Also, in the preferred embodiment, the bit 325 is an expandable bit with extendable portions that can be selectively and remotely activated to enlarge the diameter of the bit 325 to a size greater than the outer diameter of the liner 310.

Figure 18:
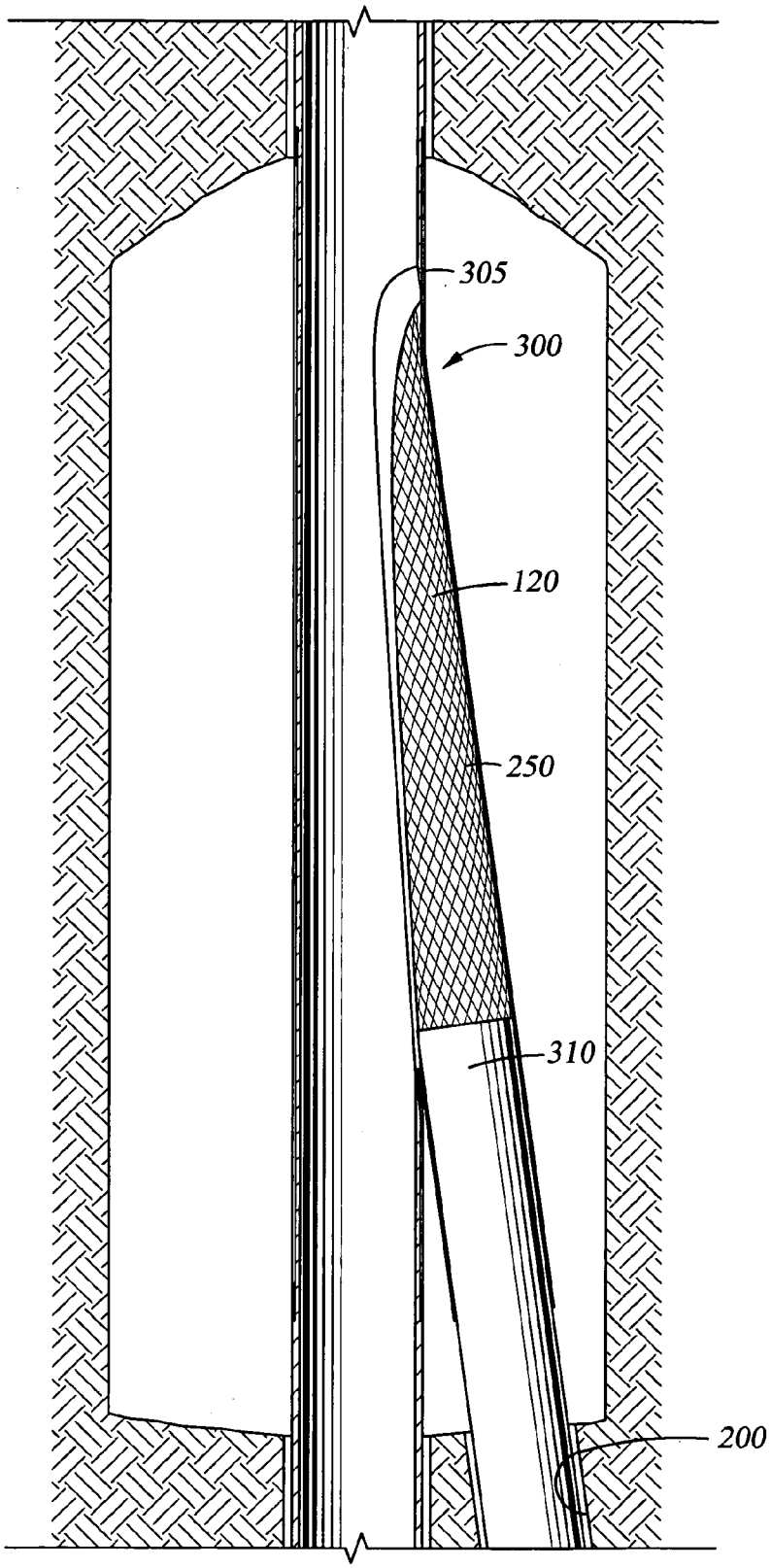
FIG. 18 is a partial section view illustrating the lateral wellbore completely formed and the junction between the liner and the casing window completely covered with the screen material.

FIG. 18 is a partial section view showing the lateral wellbore 200 completely formed and the interface or junction 300 between the liner 310 and the casing window 305 completely covered with the screen material 120. Typically, the whipstock in the casing 110 is removed after formation of the lateral wellbore 200 and the expandable bit (not shown) is left in the end of the newly formed lateral wellbore 200.

Figure 19:
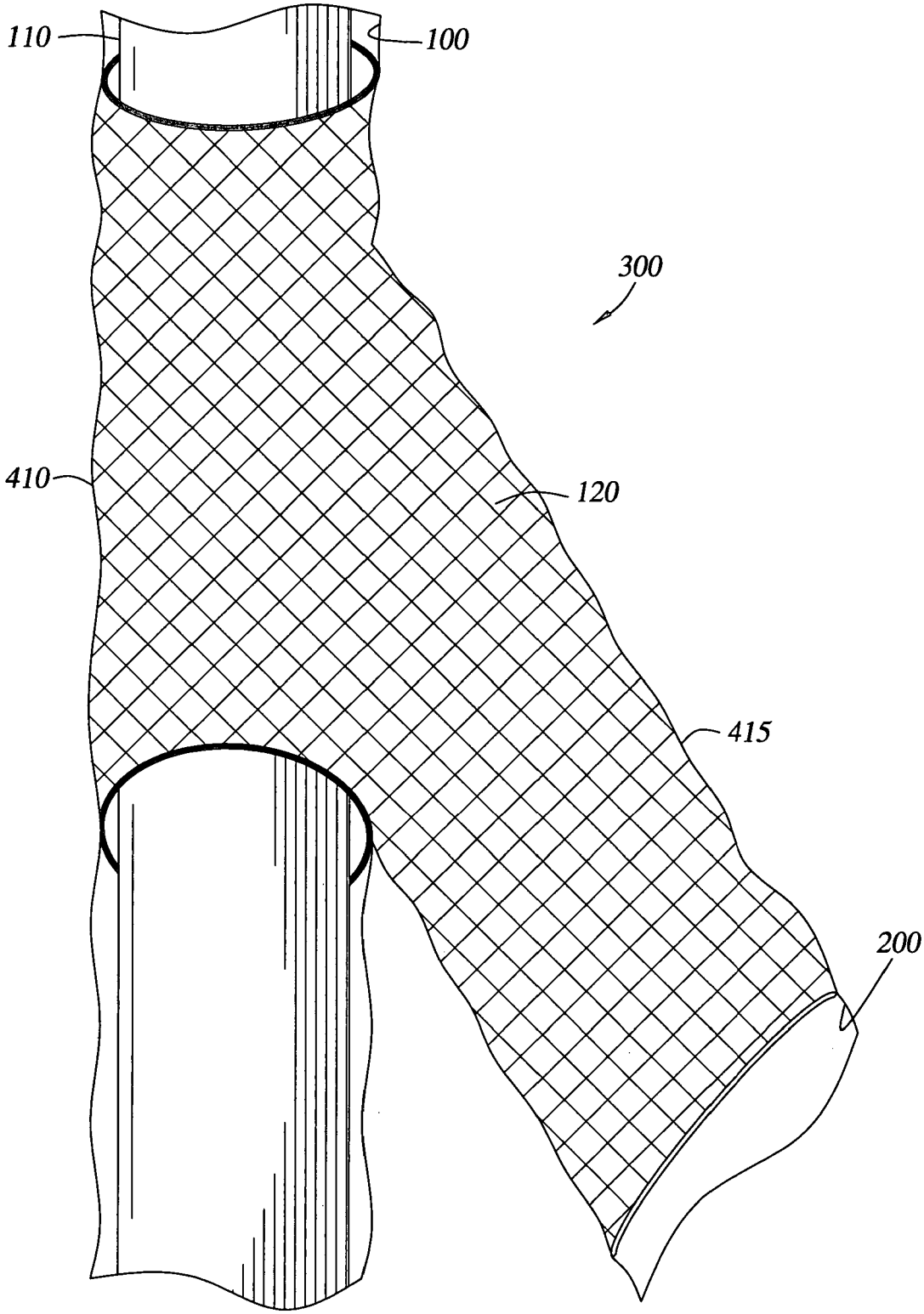
FIG. 19 is an elevation view of a central wellbore and a lateral wellbore illustrating the use of a screen portion to line and strengthen a junction formed between the two wellbores.

FIG. 19 is an elevation view of a central wellbore 100 and a lateral wellbore 200 illustrating the use of a screen portion 120 to line and strengthen a junction 300 formed between the two wellbores 100, 200. The screen portion 120 would typically be run-in into the wellbore 100 on a string of tubulars (not shown) and then, a central portion 410 of the screen 120 expanded against a wall of the central wellbore 100 and a lateral portion 415 extended and expanded against a wall of the lateral wellbore 200. Due to the relatively stiff nature of the screen material 120, it can easily be transferred downhole in a collapsed or folded orientation and subsequently extended and expanded to take the shape illustrated in FIG. 19. In FIG. 19, the central wellbore 100 also includes a casing 110 which enters an upper end of the central portion 410 of the screen 120 and exits a lower end thereof permitting the central wellbore 100 to be utilized below the reinforced junction 300. Alternatively, or in addition to the casing 110 running vertical through the screen portion, a string of liner (not shown) could extend through the lateral portion 415 and into the lateral wellbore 200 therebelow.

Figure 20A:
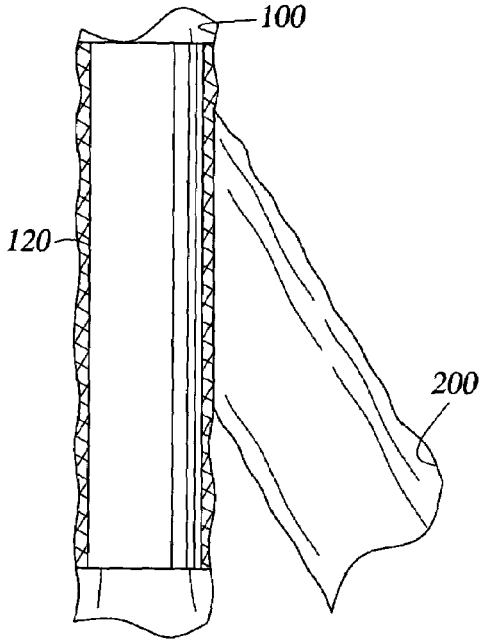
FIGS. 20A–20D illustrate a method for inserting screen portions into a central and lateral wellbores to protect and strengthen the wellbores during drilling operation.
Figure 20B:
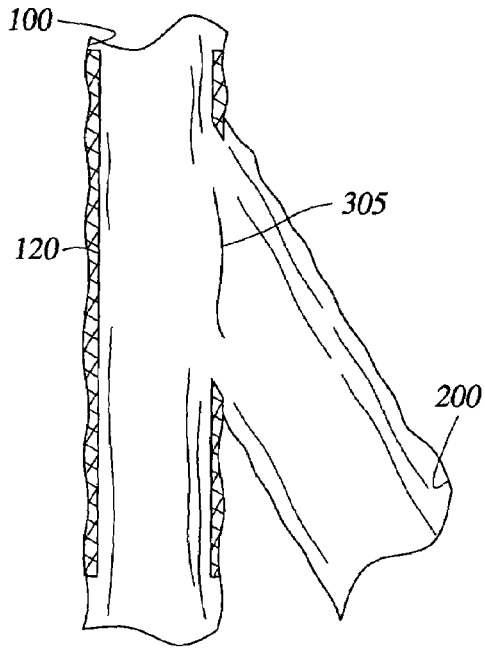
Figure 20C:
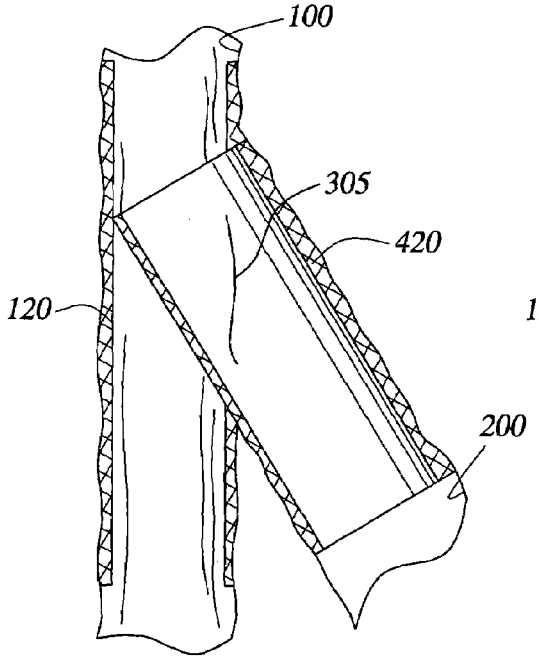
Figure 20D:
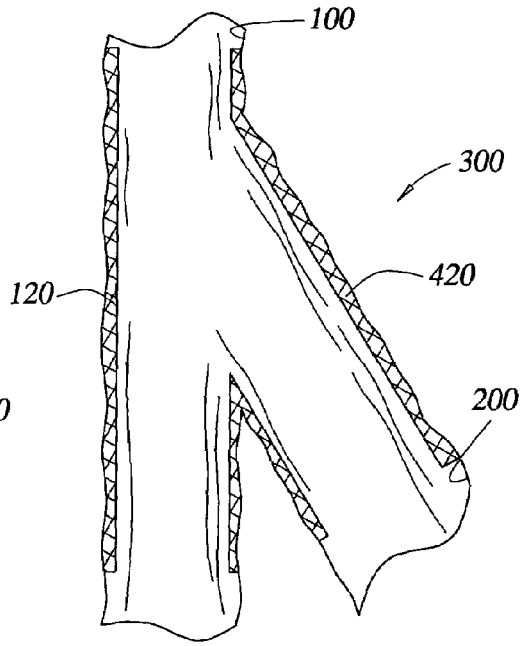

FIGS. 20A–20D illustrate a method for inserting screen portions 120 into a central 100 and lateral 200 wellbores in order to protect and strengthen the wellbores 100, 200 during drilling. FIG. 20A shows the central wellbore 100 with the lateral wellbore 200 extending therefrom. Disposed along the walls of the central wellbore 100 is a tubular screen portion 120 which is run-in into the wellbore 100 and extended or expanded therein to contact the wellbore 100 walls. FIG. 20B illustrates the central and lateral wellbores 100, 200 of FIG. 20A with the screen portion 120 having been penetrated and a window 305 formed therein to permit communication between the central and lateral wellbores 100, 200. FIG. 20C illustrates a second tube-shape screen portion 420 which has been run into the lateral wellbore 200, inserted through the window 305 formed in the first screen portion 120 and then extended or expanded against the walls of the lateral wellbore 200. Finally, FIG. 20D illustrates the wellbore junction 300 completely lined and strengthened with the screen material 120, 420. The second tubular shape screen member 420 has been deformed whereby a portion of it extending into the central wellbore 100 has been folded down to further line the central wellbore 100 below the window 305. In this manner, using separate tubular screen members 120, 420 any portion of a wellbore junction 300 can be selectively lined and strengthened. Additionally, while the illustration shows only one lateral wellbore 200, it will be understood that any junction can be reinforced, even one having multiple lateral wellbores extending therefrom.

Figure 21A:
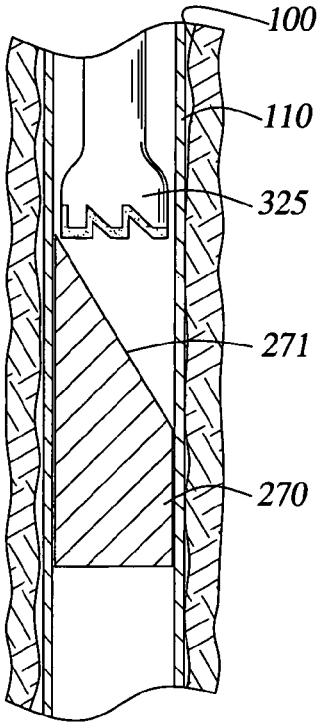
FIGS. 21A–21C illustrate another embodiment of the invention wherein a junction between a central and lateral wellbores is reinforced with screen material prior to forming the lateral wellbore.
Figure 21B:
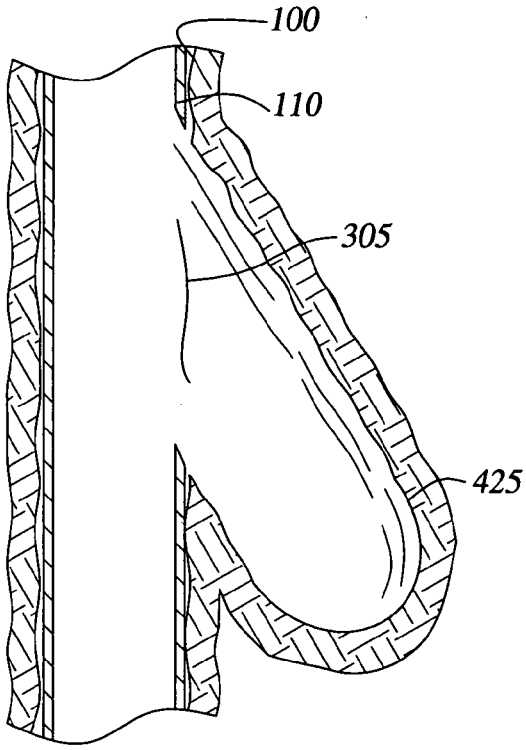
Figure 21C:
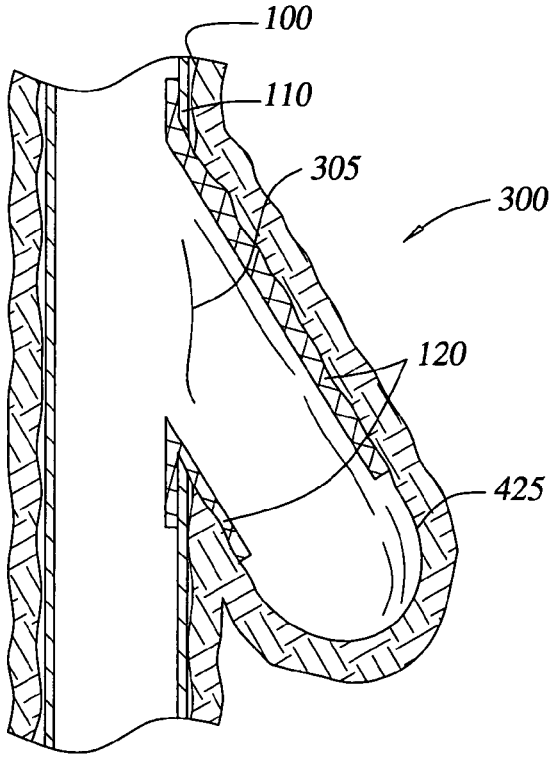

FIGS. 21A–21C illustrate another embodiment of the invention wherein a junction 300 between a central and lateral wellbores 100, 200 is reinforced with screen material 120 prior to forming the lateral wellbore 200. FIG. 21A illustrates the central wellbore 100 having casing 110 disposed therein. Located in the casing 110 is a whipstock 270 having an inclined surface 271 and, thereabove, a milling bit 325 as would be run into the wellbore 100 and used to form a window 305 in a wall of the casing 110. Milling bits 325 are well known in the art and typically are used to form casing windows and thereafter they are removed from the wellbore and replaced with a more conventional drill bit which forms the lateral wellbore 200. FIG. 21B illustrates the central wellbore 100 after window 305 has been formed in the wall of the casing 110 by the milling bit which has been removed. As illustrated in FIG. 21B, the formation of the casing window 305 necessarily results in an extension 425 which is formed in the earth outwards of the window 305. FIG. 21C illustrates the central wellbore 100, the casing window 305 and the extension 425 after the junction 300 between the wellbore 100 and extension 425 has been reinforced with screen material 120. As with previous embodiments, the screen material 120 may be run into and inserted at the junction 305 in a variety of ways. For example, a tubular shape of the screen can be run into the wellbore 100 in a collapsed condition and thereafter urged through the casing window by a bent sub or a diverting device (not shown). Thereafter, using a cone-shaped object (not shown) run-in on a string of tubulars (not shown), the screen 120 can be expanded into contact with the walls of the central wellbore 100, and the extension 425.

In addition to those methods described, the screen portion 120 may can be expanded using an expander tool (i.e., see FIGS. 26–29) which includes at least one radially extendable member disposed on a body and extendable through fluid pressure delivered to the body through a string of tubulars having pressurized fluid therein. Expander tools are well known in the art and an example of one is taught in U.S. Pat. No. 6,425,444, assigned to the same owner as the present application and that patent is incorporated herein in its entirety.

Figure 22:
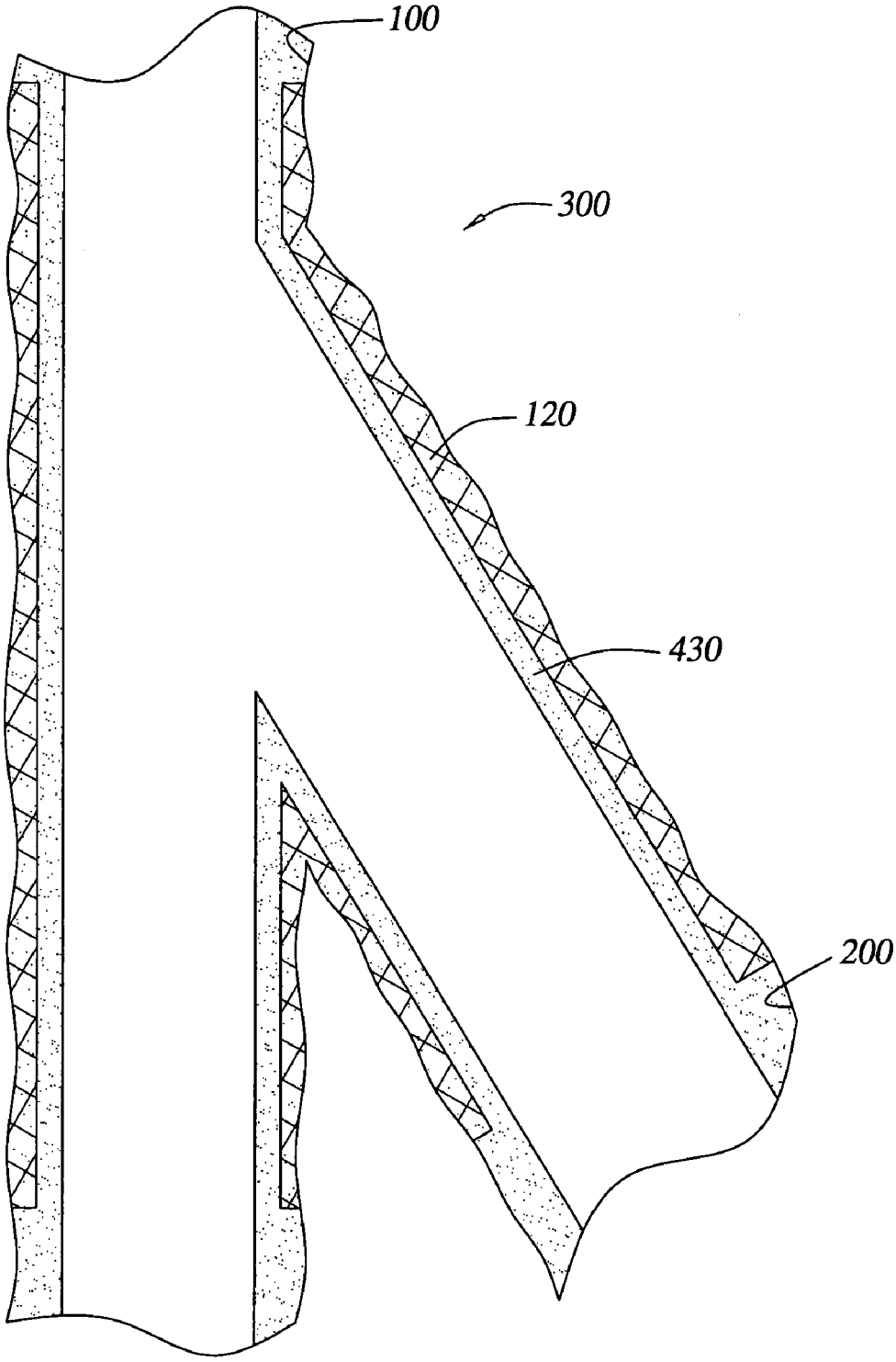
FIG. 22 illustrates the use of a screen portion to reinforce cement that is used in and around a wellbore junction.

FIG. 22 illustrates a central wellbore 100 having a lateral wellbore 200 extending therefrom and specifically teaches the use of the screen portion 120 of the invention to reinforce cement 430 that is used in and around a wellbore junction 300. In FIG. 22 the junction 300 between the central and lateral wellbores 100, 200 has been strengthened through the use of at least one screen portion 120 as described with reference to other embodiments of the invention. Thereafter, tubular strings (not shown) in each wellbore 100, 200 are cemented in place using cementing techniques well known in the art. Rather than leaving a layer of fragile cement 430 between a tubular member and the earthen walls of the wellbores 100, 200, the screen 120 is at least partially permeated by the cement 430 and serves as a reinforcing member to protect the cement 430 from shock and breakage, especially due to pressure differentials.

Figure 23:
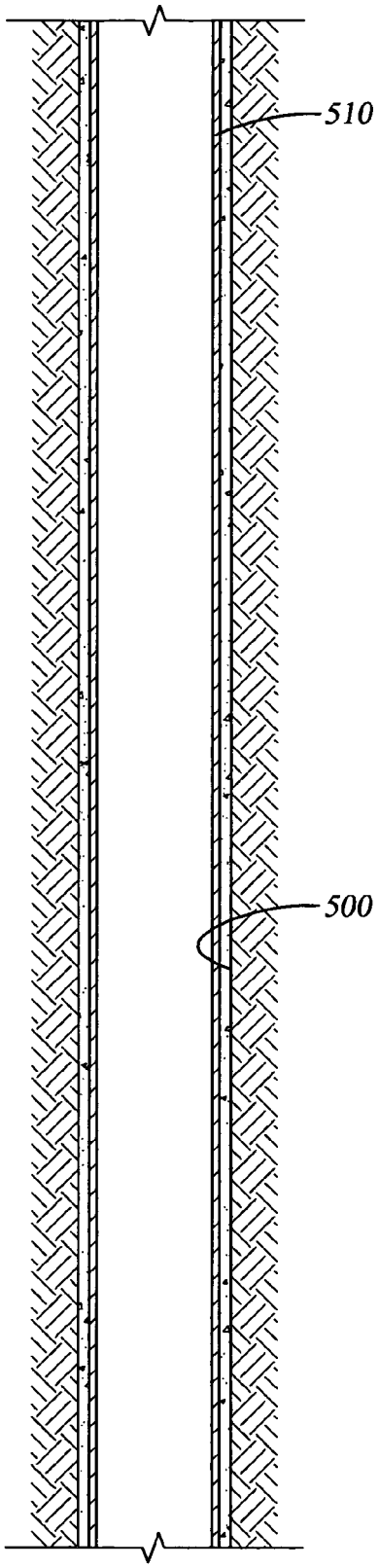
FIGS. 23–29 illustrate the steps of a method wherein the screen is installed on an expandable tubular which is subsequently expanded to fix the screen into the junction.
Figure 24:
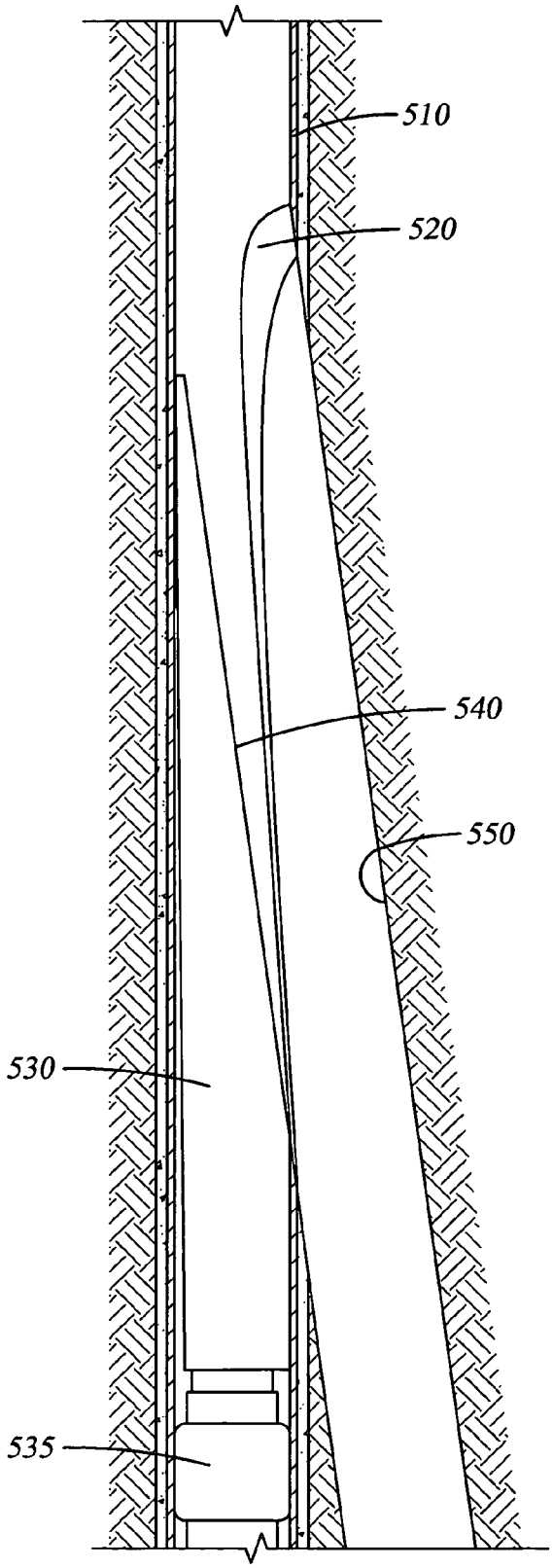
Figure 25:
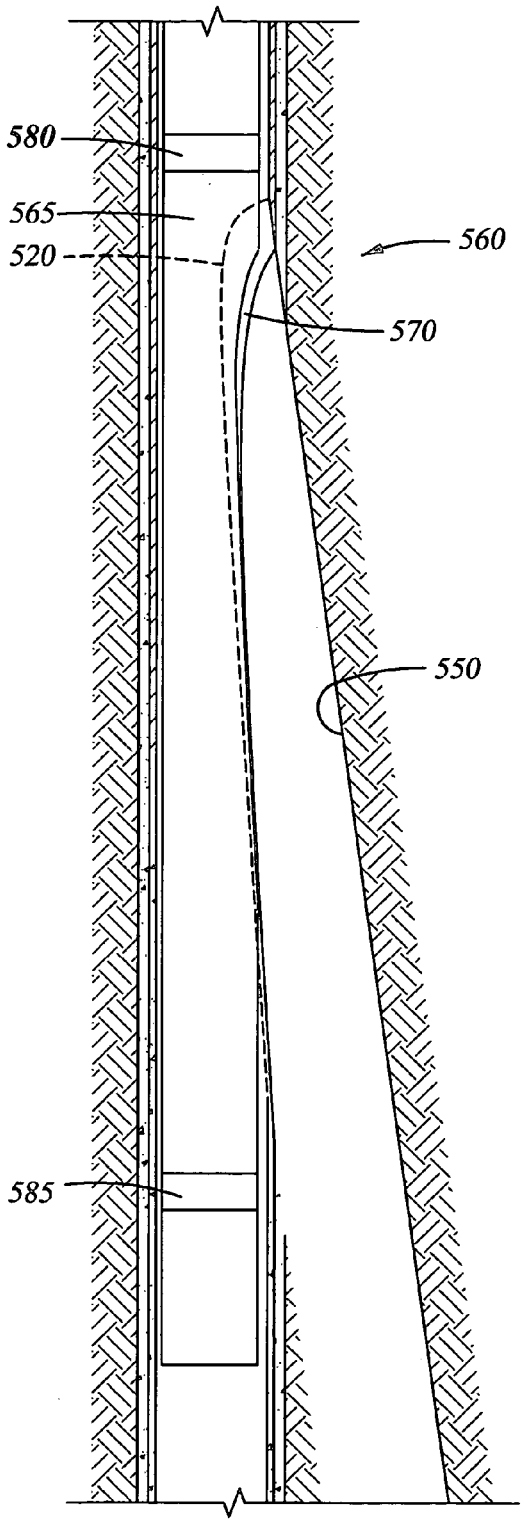
Figure 26:
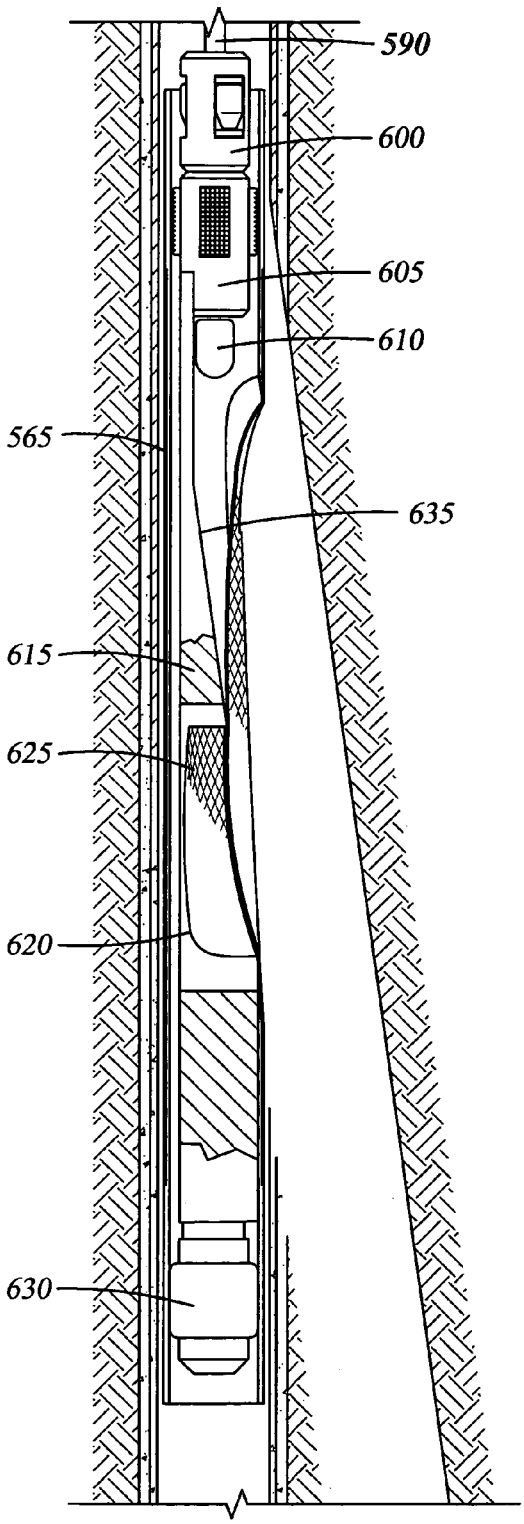

In another embodiment of the invention, a screen portion is utilized in a junction of wellbore which is created from an existing, cased central wellbore. FIG. 23 is a section view illustrating a central wellbore 500 with casing 510 cemented therein. FIG. 24 is a section view of the wellbore after a window 520 has been formed in a wall of the casing 510. Visible in FIG. 24 is a whipstock 530 held in place by an anchor 535 and having an inclined portion 540 which is utilized by a mill and drill bit which forms the casing window and a lateral wellbore 550. FIG. 25 is a section view of the wellbore illustrating the junction 560 between the central and lateral wellbores. The apparatus used in forming the casing window 520 and the lateral wellbore 550 has been removed and a tubular member 565, housing various components, has been lowered into the wellbore. The tubular member includes a window 570 formed therein as well as an upper and lower rings 580, 585 used to retain a screen portion (not shown) around the tubular member 565. FIG. 26 is a section view of the tubular member 565 showing the various components therein. From the top of FIG. 26 towards the bottom, the components include a run-in string 590, an expander tool 600, a torque anchor 605 disposed therebelow and a cone member 610 disposed below the torque anchor. Disposed further downwards in the tubular member is a whipstock 615 having a cut-out portion 620 formed therein constructed and arranged to house a pant-leg portion 625 of screen. Disposed below the whipstock is a packer 630. The screen portion, including the pant-leg portion 625 is arranged in the tubular member and within the cut-out portion 620 of the whipstock in a similar fashion as discussed with previous embodiments. The tubular member 565 may be replaced by the multi-layered, expandable screen discussed above.

Figure 27:
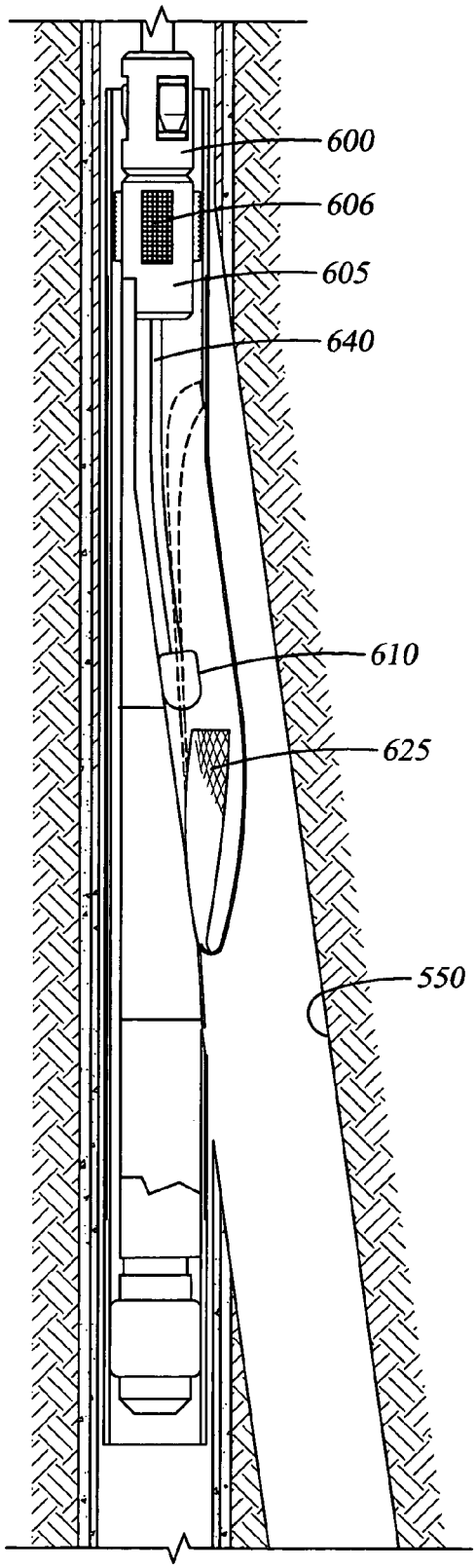

FIG. 27 is a section view of the apparatus illustrating the cone member 610 having been extended downwards along an inclined surface 635 of the whipstock to a location whereby it interferes and upsets the pant-leg portion 625 of the screen. As shown in FIG. 27, the cone 610 is extended downward and has urged a folded portion of the pant-leg 625 outwards towards the lateral wellbore 550. The cone moves downward on a relatively small diameter pipe 640 which is movable axially independently of the other components. As the screen portion is manipulated, the tubular member and other components are held in the wellbore by torque anchor 605 which includes radially extendable gripping portions 606 disposed therearound.

Figure 28:
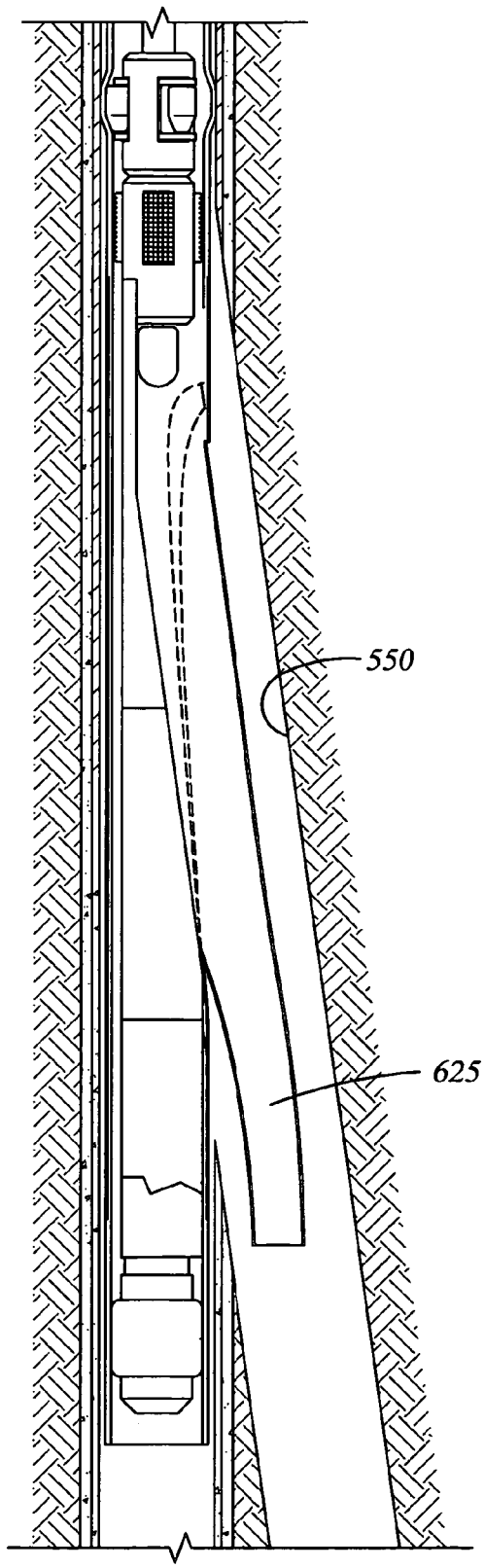

FIG. 28 illustrates the pant-leg portion 625 of the screen completely unfolded and extended out into lateral wellbore 550. With the pant-leg portion completely extended outwards, the expander tool can be activated and radially extendable rollers thereupon extend outward to push walls of the tubular portion into gripping contact with the casing therearound. In this manner, and with some axially movement of the expander tool, the assembly including the tubular member and the components therein becomes fixed in the wellbore. Thereafter, with the packer 630 disengaged and the torque anchor and expander tool deactivated, the assembly, including the whipstock 615 can be removed from the wellbore. Alternatively, the expander tool can be moved downwards to a position below the window and reactivated, thereby sealing an annular area formed between the outer surface of the tubular member and the casing wall. In this manner, any flow of fluid is prevented from passing through the wellbore without coming into contact with the screen portion.

Figure 29:
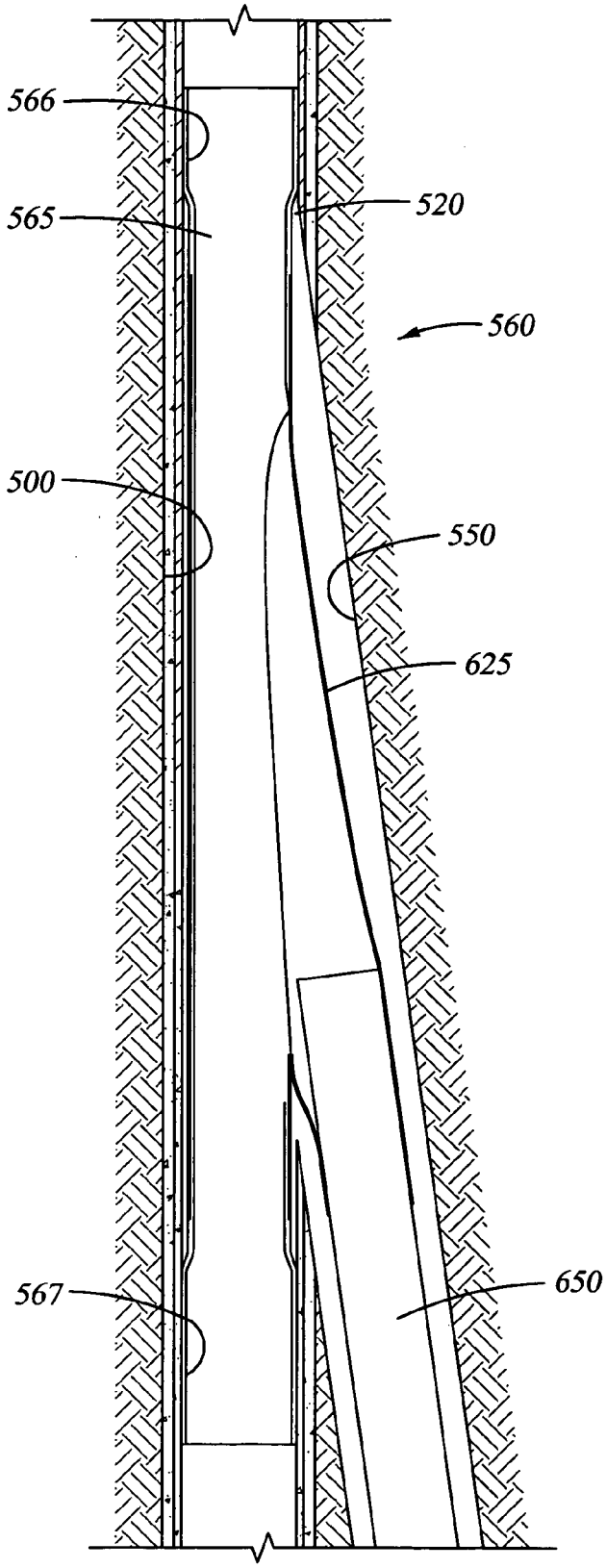

FIG. 29 illustrates the components removed leaving only the tubular portion 565 with its preformed window 520 and the screen therein and a string of liner 650 extending through the window and into the lateral wellbore 550. A whipstock used to insert the liner through the casing window has also been removed. As is visible in FIG. 29, the junction 560 between the liner and the casing window is substantially covered with the screen material and any solids can be filtered while fluids can pass through the screen material. Expanded portions 566, 567 seal the annular area between the casing and the tubular portion 565.

Figure 30A:
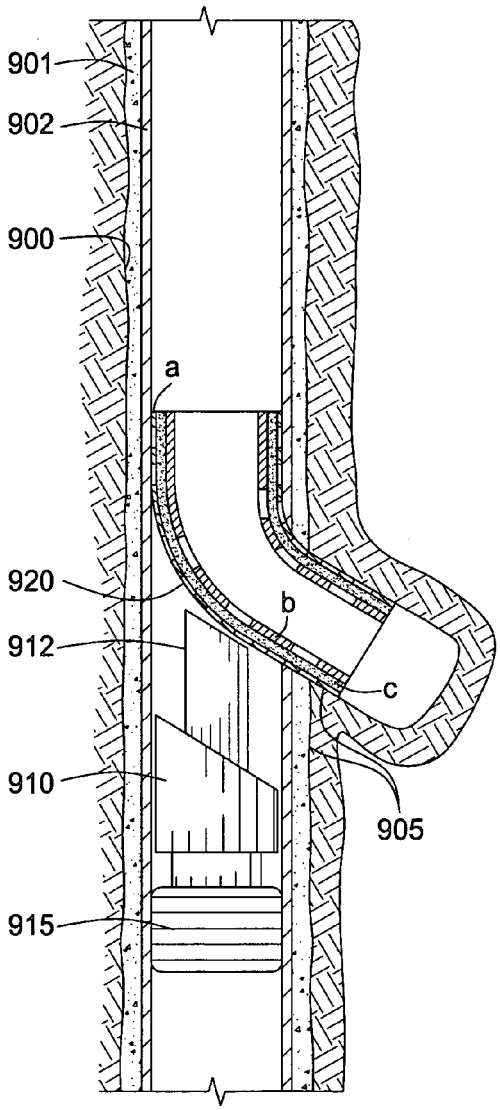
FIG. 30 presents three cross-sectional views of a multilateral wellbore junction. Each of FIGS. 30A–30C presents a different expandable junction component that has been installed at the intersection of the primary and lateral wellbores.
FIG. 30D illustrates different perforation configurations that may be employed in the sand screen junction components.
Figure 30B:
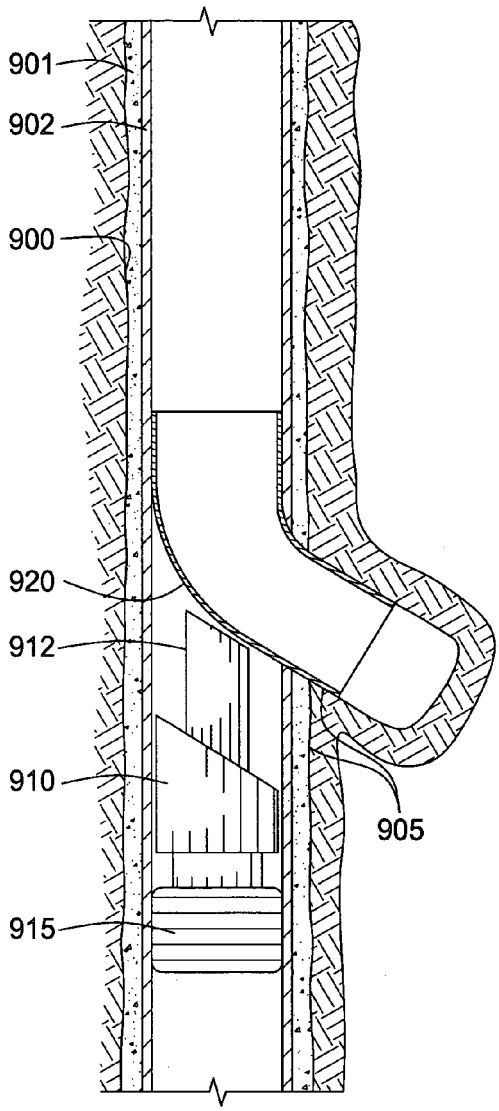
Figure 30C:
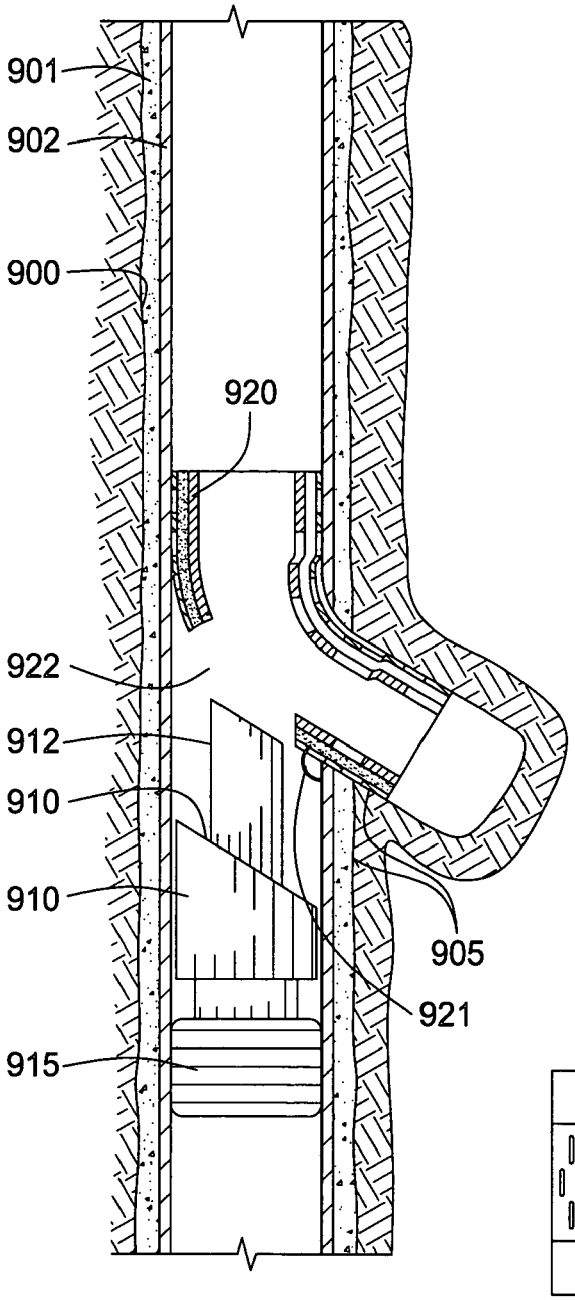

FIGS. 30A–C present three cross-sectional views of a multilateral wellbore. In one embodiment, a lateral wellbore junction 905 has been formed off of a cased 902 and cemented 901 primary wellbore 900. In order to accomplish this, a whipstock (not shown), a deflector 910, and an anchor 915 are lowered into the primary wellbore 900. The whipstock is properly oriented and located using conventional MWD, gyro, pipe tally, or radioactive tags. The anchor 915 is set. A window is milled/drilled through the casing 902 and the cement 901, using the whipstock (not shown) as a guide, and the drilling is continued until a junction 905 is formed. Since expandable junctions 920 will be installed, the wellbore junction 905 may be under-reamed, such as with a bi-center or expandable bit, resulting in an inside diameter near that of the central wellbore 900. The whipstock (not shown) is removed and replaced by a deflector stem 912. The deflector stem 912 and deflector device 910 may comprise a mating orientation feature (not shown), such as a key and keyway, for properly orientating the deflector stem into the deflector device. The deflector device 910 and the anchor 915 may comprise a flow port (not shown). The anchor 915 may further comprise packing means or may be a separate anchor and packer. Once the deflector stem 912 is set, an expandable (or partially expandable, see below) junction component 920 (unexpanded) is lowered through the primary wellbore, along the deflector stem 912, to the junction 905. The junction component 920 is then expanded against the walls of the primary wellbore 900 and the junction 905 using an expander tool (i.e., see FIGS. 26–28). In each instance, the expandable components 920 are set and expanded before completing the lateral wellbore to prevent damage of the junction 905 due to subsequent drilling of the lateral wellbore.

Depicted in FIG. 30A is an expandable sand screen junction component 920, such as Weatherford's ESS®. Three layers of the sand screen 920 are shown, representing a perforated base pipe 920*c*, a protective outer shroud 920*a*, and an intermediate filter media 920*b*. Slots are seen within the base pipe 920*c* and the shroud 920*a*. In FIG. 30, the sand screen 920 is shown in its expanded position. In this manner, the sand screen 920 is expanded downhole against the casing 902 and the junction 905 in order to preserve the integrity of the junction 905 during subsequent drilling and production. A more particular description of an expandable sand screen is described in U.S. Pat. No. 5,901,789, which is incorporated by reference herein in its entirety.

Figure 30D:
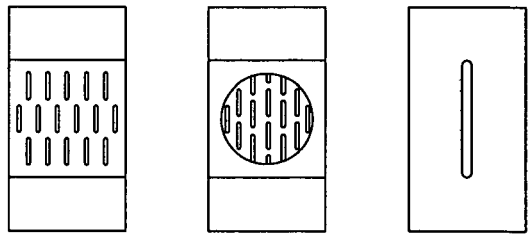

Illustrated in FIG. 30B is a solid expandable junction component 920. Depicted in FIG. 30C is a partially expandable sand screen junction component 920 with a preformed central wellbore access port 922. In FIG. 30C, note that the component 920 is shown only partially expanded because the preformed port 922 may not allow expansion of the component over the portion it covers. A mating feature, such as a hook 921, is provided on the partially expandable junction component to retain it inside the junction during expansion and to properly locate and orient it at the junction. The mating feature may be disposed on the other junction components. The hook 921 may be permanent, temporary, or shearable. Other means can be used to orient and locate the junction components, such as conventional MWD, gyro, pipe tally, or radioactive tags. The partially expandable component 920 may also be solid. FIG. 30D illustrates various perforation configurations that may be formed in the sand screen junction components. As discussed earlier, the sand screen junction components will allow production at the junction 905 while filtering particulate matter out of the production fluid. The sand screen components shown in FIGS. 30A and 30C need not be multi-layered.

Figure 31A:
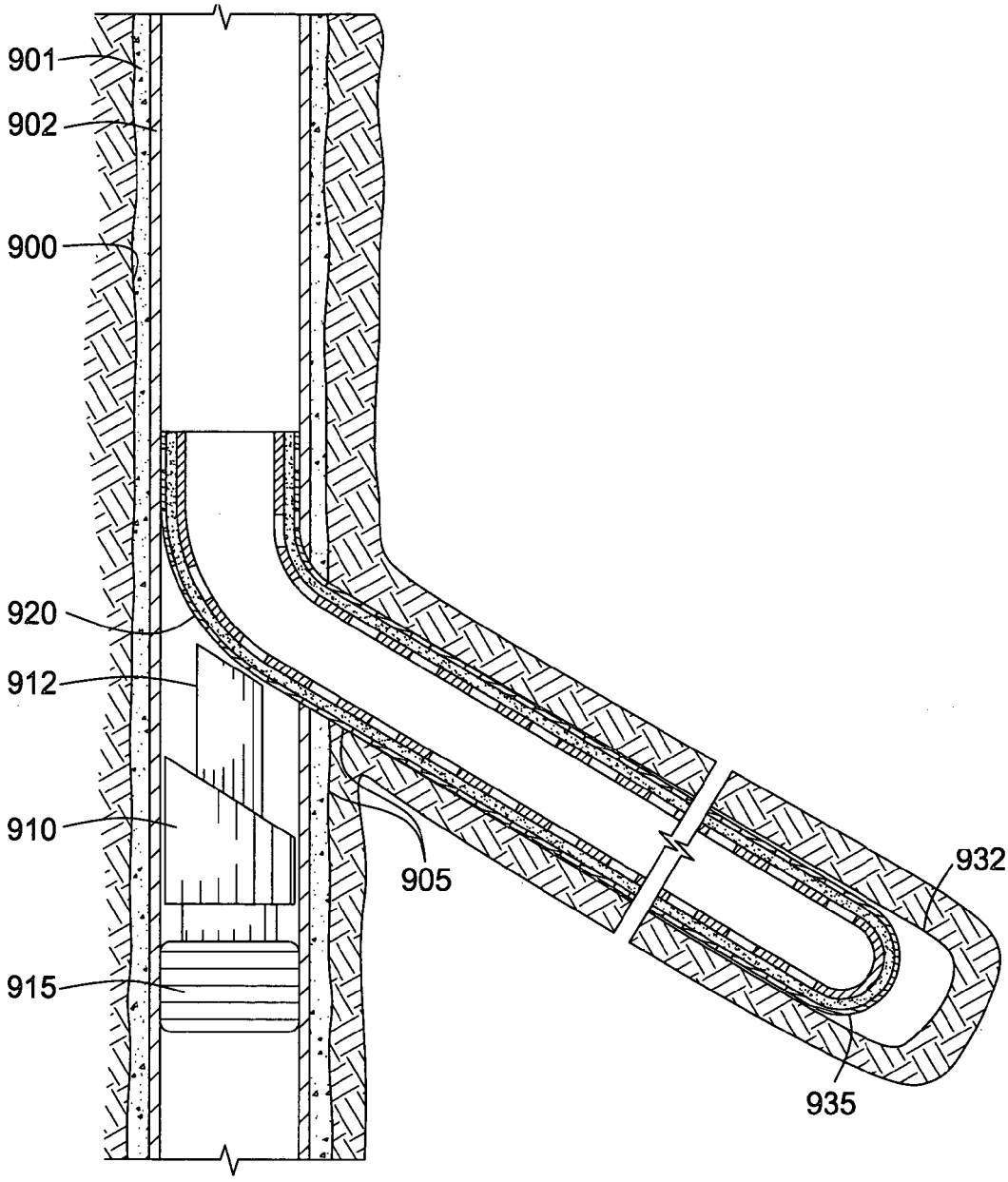
FIGS. 31A and 31B illustrate completion of the lateral wellbore with expandable production tubing.
Figure 31B:
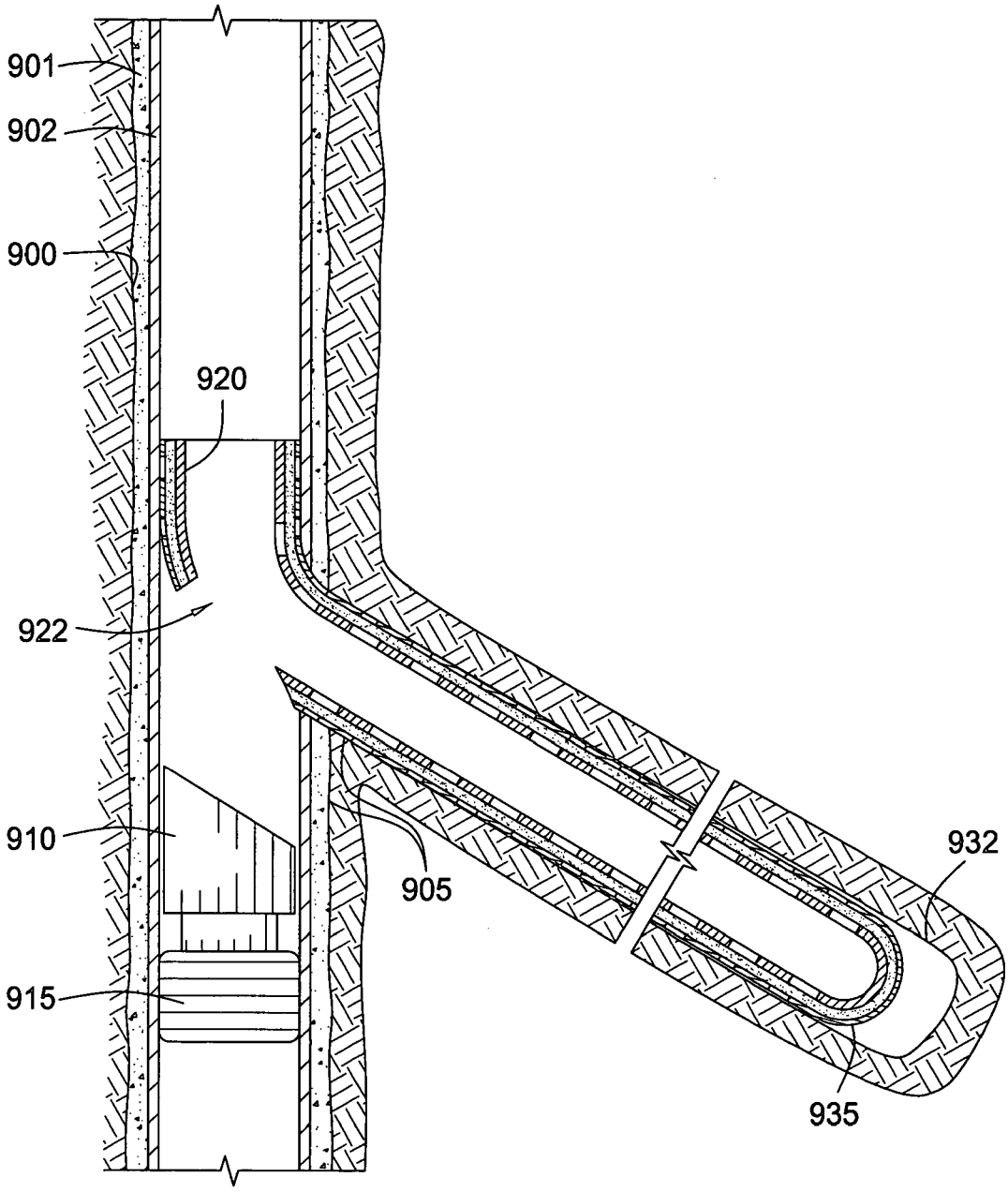

FIGS. 31A–B and 31C–D provides two alternate completion methods to that displayed in FIGS. 30A–C. In this embodiment, a lateral wellbore 932 has been formed off of a cased 902 and cemented 901 primary wellbore 900. Contrary to the earlier described method, the entire lateral wellbore 932 is drilled before installation of the junction component 920. In FIG. 31A, the junction component 920 is installed with expandable sand screen production tubing 935 extending through lateral wellbore 932. The component 920 and the production tubing 935 are expanded together in one step. Expansion of the sand screens 920 and 935 obviates the need for a gravel pack, and allows for a larger i.d. within the junction 905. The junction component 920 does not have to be separate from the production tubing 935; it may just comprise the portion of the production tubing 935 located in the vicinity of the junction 905. The production tubing 935 may be sand screen, solid, or a combination of both. Any of the junction components 920 displayed in FIGS. 30A–C may be used. For example, if there is no reservoir in the vicinity of the junction 905 or if there is a reservoir containing undesirable fluid, i.e. water, a solid junction component 920 would be preferable so as to isolate the junction. This would prevent escape of production fluid into the junction 905 in the former case and prevent commingling of an undesirable fluid in the latter case. If production equipment is desired in the central wellbore 900 below the junction (discussed below), the junction component 920 must be milled out to create a central wellbore access port 922 as shown in FIG. 31B. The deflector stem 912 may also be retrieved after milling as shown in FIG. 31B. If the solid junction component 920 is used, it must be milled to allow production from the central wellbore 900 below the junction 905.

Figure 31C:
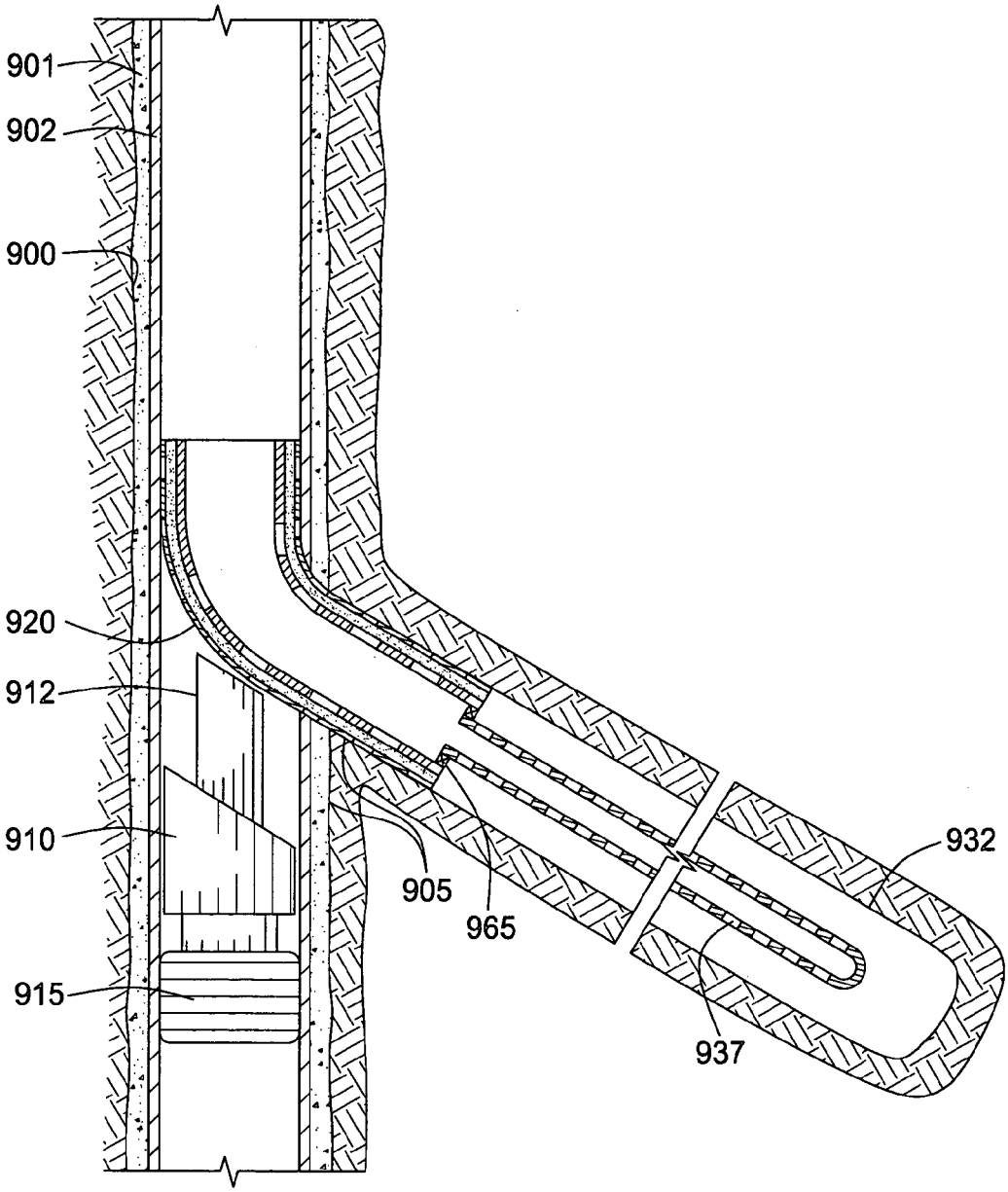
FIGS. 31C and 31D illustrate completion of the lateral wellbore with conventional production tubing.
Figure 31D:
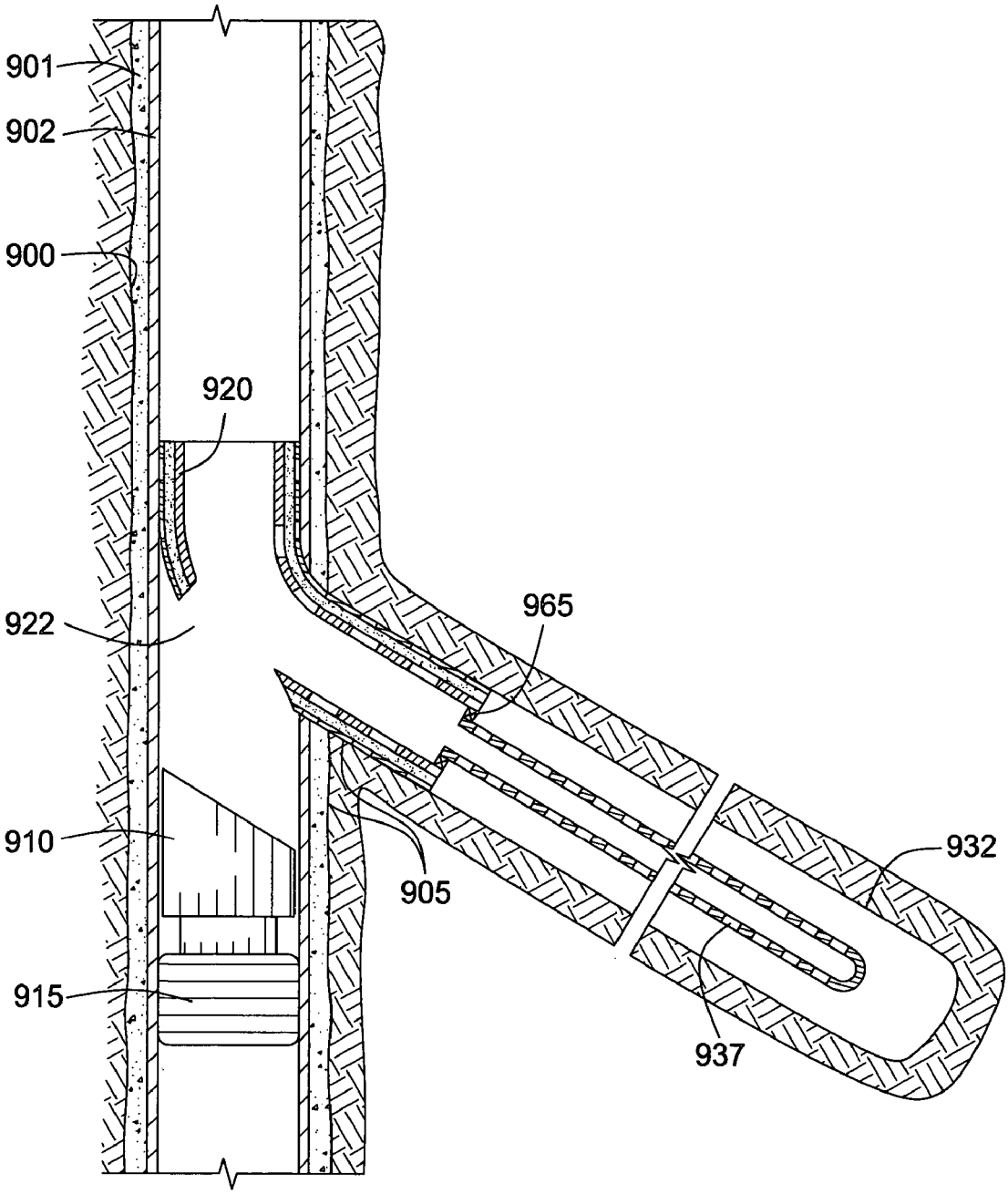

In FIG. 31C, the expandable sand screen junction component 920 is installed before any production tubing 937. The production tubing 937 is then lowered through the expandable junction component 920 and coupled to the end of the junction component proximate the lateral wellbore 932 by a packer 965. The packer 965 may be part of a liner hanger. In this embodiment, the production tubing 937 is conventional (non-expandable) and slotted. This configuration is preferable for the case where a desirable reservoir (not shown) extends the length of the junction 905 and lateral wellbore 932, since the junction is not isolated from the lateral wellbore. The production tubing 937 may be solid when installed and later perforated by known means, such as perfing, chemical cut, mechanical cut, milling, drilling, explosives, dissolving, piercing, forming, or punching. Again, if additional production equipment is desired in the central wellbore 900 below the junction 905, then the slotted junction component 920 must be milled as shown in FIG. 31D. Again, the deflector stem 912 has been retrieved from the deflector device 910 as shown in FIG. 31D. Of course, the lateral wellbore 932 may be left open and no production tubing provided, if desired. Again, any of the junction components 920 displayed in FIGS. 30A–C may be used.

Either completion method, discussed with reference to FIGS. 31A–B or FIGS. 31C–D, may comprise the extra steps of first drilling the junction 905, installing the junction component 920, and then drilling the lateral wellbore 932 to completion as discussed above with reference to FIG. 30.

FIGS. 32A–D provide four alternate completion methods for a multilateral wellbore. In each instance, a lateral wellbore 932 has been formed off of a cased 902 and cemented 901 primary wellbore 900. A junction component 920 is shown in each view. Further, in each view, the central wellbore access port 922 has been formed (or pre-formed) in the bottom of the junction component in order to provide access to the primary wellbore 900 below the junction 905. The junction 905 and lateral wellbore 932 configurations shown in FIG. 32 have been completed according to the methods discussed above with reference to FIGS. 31A and 31B. These configurations could also be completed with the methods discussed above with reference to FIGS. 30, 31C, and 31D.

Figure 32A:
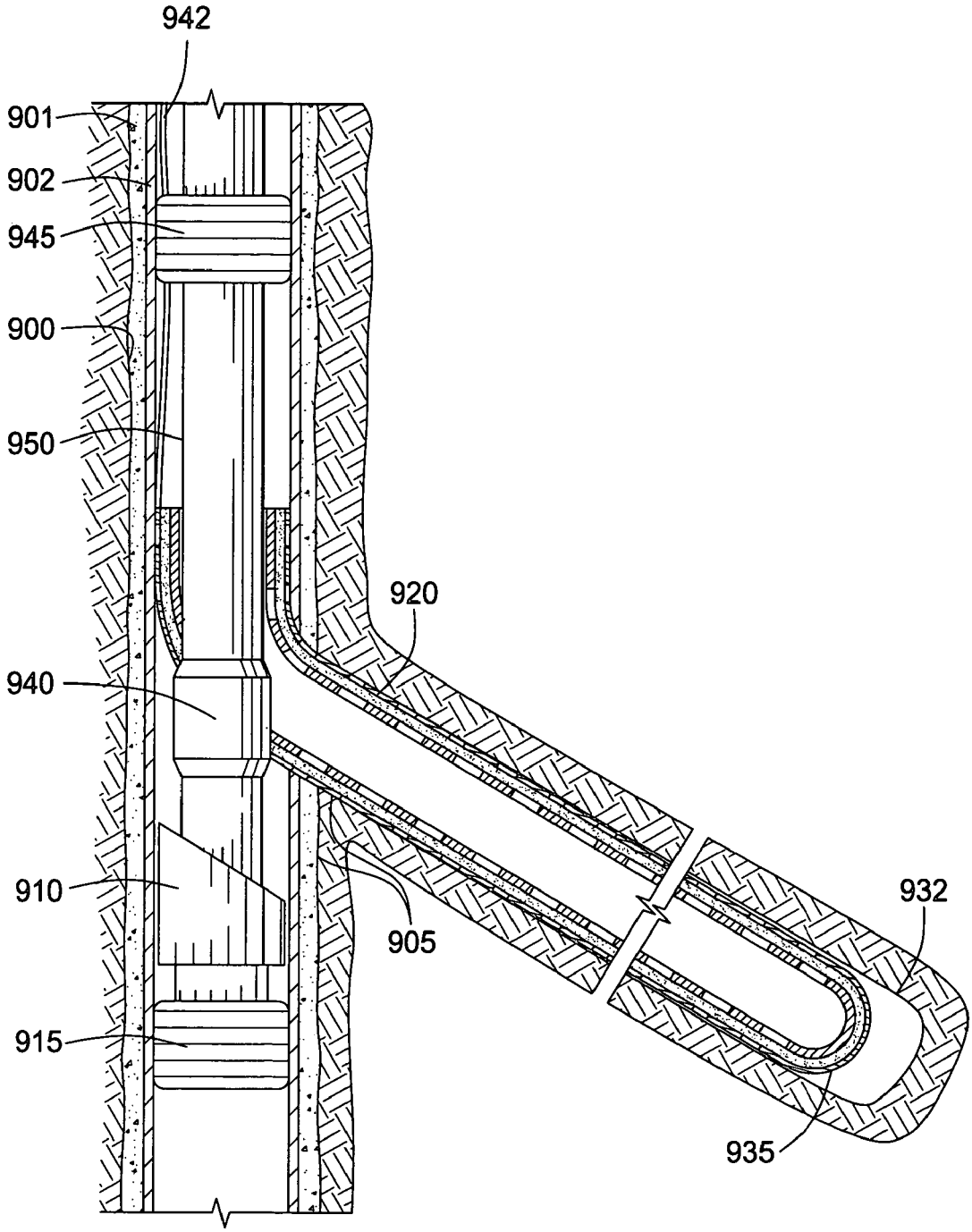
FIG. 32A illustrates pumping from the central wellbore while isolating the lateral wellbore with mono-bore completion to the surface.
Figure 32B:
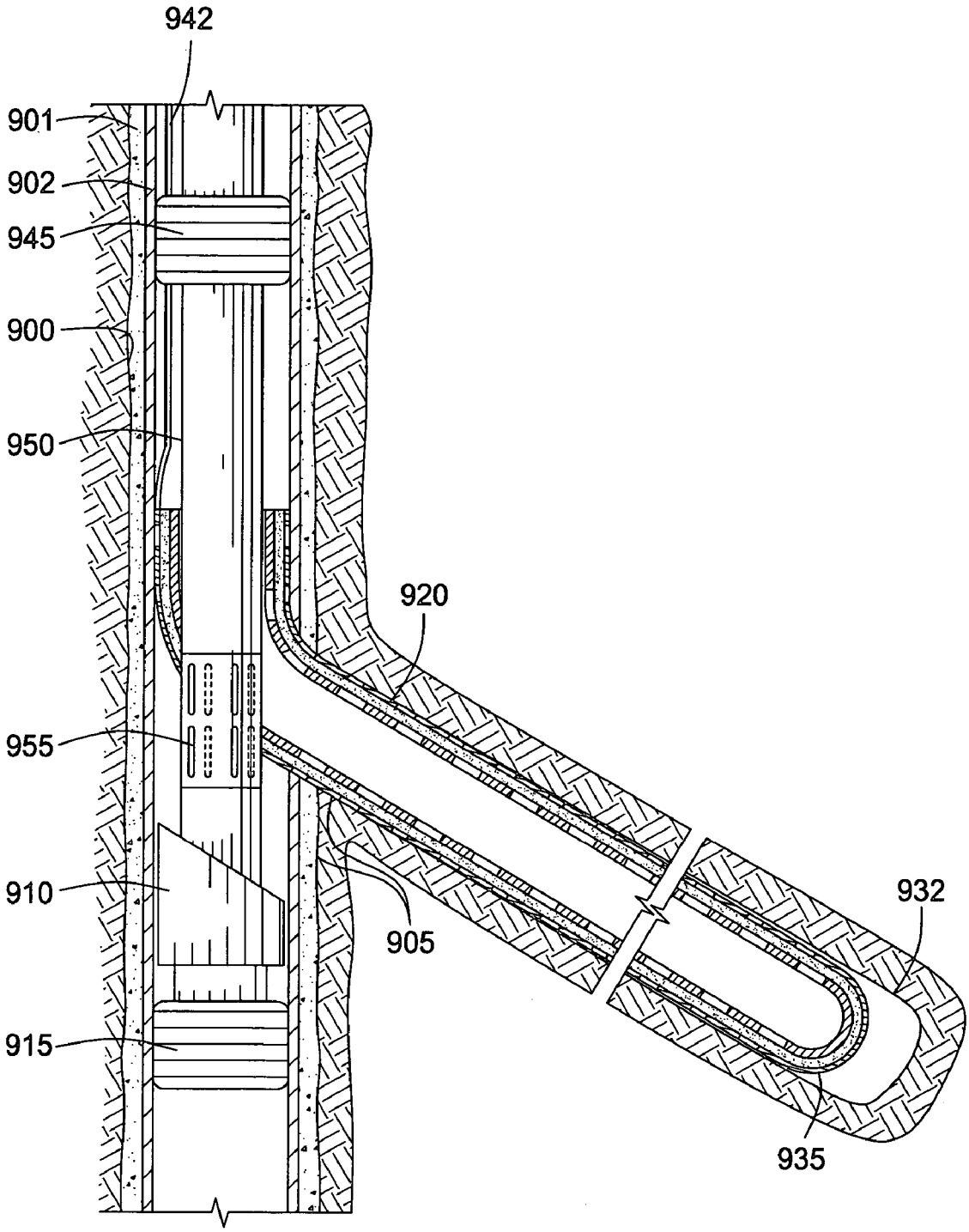
FIGS. 32B illustrates selective production between central wellbore production and commingled central wellbore and lateral wellbore production, with mono-bore completion to the surface.

Shown in FIGS. 32A and 32B, a single production string 950 comprising a packer 945 is run from the surface, through the junction 905, and to the deflector 910 and anchor 915. The packer 945 is set above the junction 905 in the central wellbore 900. In FIG. 32A, a sump pump 940 having a control line 942 is disposed in the production string 950 for production in the central wellbore 900 below the junction 905. The lateral bore 932 and junction 905 are isolated by the packer 945, deflector device 910, and anchor/packer 915, thus prohibiting any production from them. In FIG. 32B, a remotely operated sleeve valve 955 having the control line 942 is included in the production string 950 at or near the location of the junction 905. This enables an operator to select production from the central wellbore 900 or commingled production from the central wellbore, junction 905, and lateral wellbore 932. The sleeve valve may also be used in the configuration shown in FIG. 32A to allow for production from the junction 905 and the lateral wellbore 932.

The control line 942 runs within an encapsulation from the surface (not shown) along the production string 950. The encapsulation 12 is secured to the production string 950 by clamps (not shown). The clamps are typically secured to the production string 950 approximately every ten meters. The encapsulation 12 passes through the packer 945 (or utilized hanging apparatus), and extends downward to the top of the sand screen 920. The control line 942 enters a recess (not shown) in the outer diameter of the junction component 920. Arrangements for the recess are described more fully in the pending application entitled "Profiled Recess for Instrumented Expandable Components," having S/N No. 09/964,034, which is incorporated herein in its entirety, by reference. However, the control line 942 may also be housed in a specially profiled encapsulation around the component 920 which contains arcuate walls. Arrangements for the encapsulation are described more fully in the pending application entitled "Profiled Encapsulation for Use With Expandable Sand Screen," having S/N No. 09/964,160, which is also incorporated herein in its entirety, by reference.

Figure 32C:
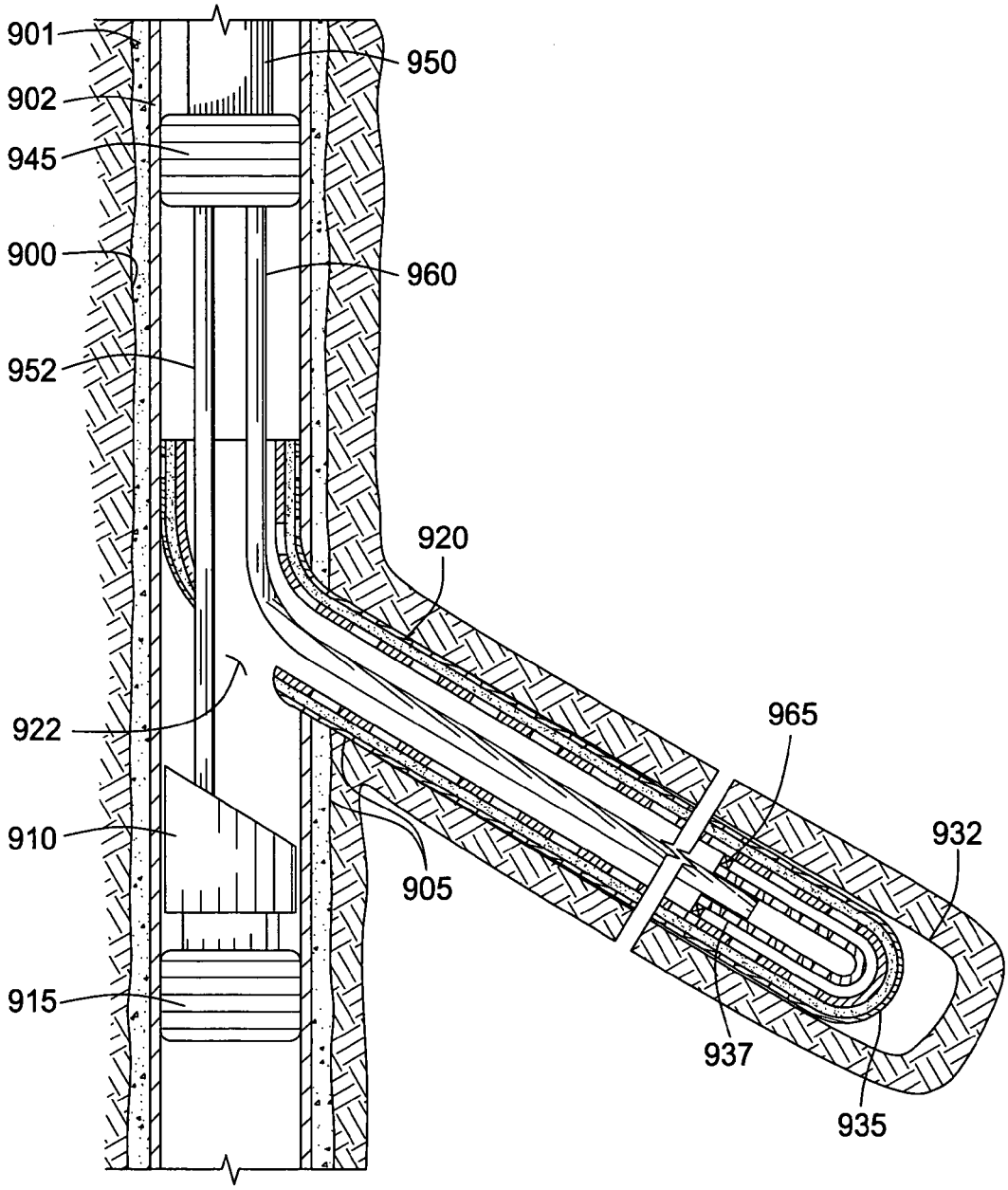
FIG. 32C illustrates commingled central wellbore and lateral wellbore production while isolating the junction, with mono-bore completion to the surface.
Figure 32D:
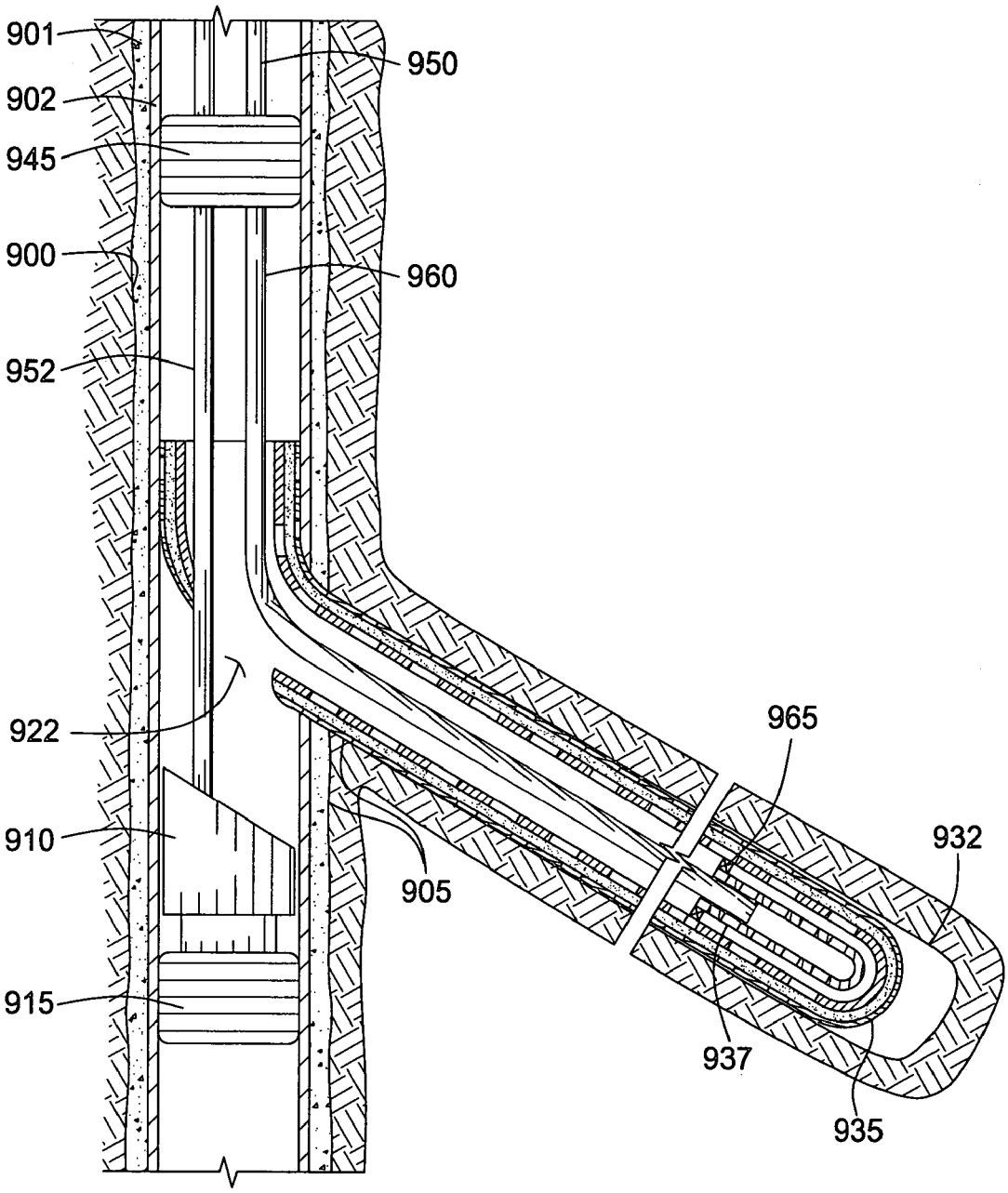
FIG. 32D illustrates simultaneous separate central wellbore and lateral wellbore production while isolating the junction, with dual-bore completion to the surface.

Illustrated in FIGS. 32C and 32D, production tubing 937 having the packer 967 is lowered into the lateral wellbore 932 and the packer 967 is set against the expandable tubing 935. This configuration will allow production string or sub-string 960 to be coupled with tubing 937. Referring to FIG. 35C, the production string 950, comprising the packer 945 and sub-strings 952 and 960, is run from the surface. The central sub-string 952 extends from the packer 945, which is again placed in the production string 950 above the junction 905, through the port 922 in the junction, and to the anchor 915 and deflector 910. The lateral production sub-string 960 extends from the packer 945, through the junction 905, to the production tubing 937. The result is commingled production from both the central wellbore 900 and the lateral wellbore 932 while completely isolating the junction 905 with the packers 945 and 965 and the anchor/packer 915. The configuration shown in FIG. 32D is similar to the one shown in FIG. 32C except that two production strings 952 and 960 coupled by packer 945 are run from the surface. The result is simultaneous separate production from the central wellbore 900 and lateral wellbore 932. Referring to FIGS. 32C and 32D, optionally, the sand screen junction component 920 could be replaced by solid expandable tubing thereby removing the need for string/sub-string 960, tubing 937, and the packer 965.

In any of the configurations illustrated in FIG. 32, the packer may be removed (replaced by just a pipe junction) utilizing the casing 902 for another production path.

While the foregoing is directed to embodiments of the present invention, other and further embodiments of the invention may be devised without departing from the basic scope thereof. For example, the junction component could have added features to act as a bridging member to solids, sands, fluid, etc. to provide a natural seal. These may include swellable elastomers, epoxys, brushes, mesh materials, fibrous materials, foam, etc. Further, the junction component could be combined with the screen, disclosed in earlier embodiments, as a further barrier to solids, etc. Further, a cementing step may be added to the completion of the lateral wellbore. Also, the junction component may be carried in a retrievable deflector on the end of a liner shoe during any installation.

The invention claimed is:

1. A junction liner for use in a wellbore comprising:

a tubular body having at least three openings for fluid communication therethrough and at least one perforation in a wall thereof, wherein the body comprises a perforated base, a filter medium disposed around the base, and a perforated shroud disposed around the filter medium.

2. The junction liner of claim 1, further comprising a mating feature.

3. The junction liner of claim 1, further comprising a seal disposed around at least a portion of an outside of the tubular body.

4. The junction liner of claim 3, wherein the seal is swellable.

5. The junction liner of claim 4, wherein the seal is disposed about substantially the entire outside of the tubular body.

6. A wellbore junction apparatus for a junction between a central and a lateral wellbore comprising:

a first tubular portion comprising a first wall with a first aperture therein, wherein the first portion comprises an expandable screen; and a second tubular portion comprising a second wall and an end operatively connected to the first portion proximate to the aperture, wherein at least one of the walls includes perforations therethrough for filtering particulates.

7. The apparatus of claim 6, wherein the portions are multi-layered.

8. The apparatus of claim 6, further comprising a tubular member coupled to the first portion.

9. The apparatus of claim 8, wherein the first portion is substantially disposed within the tubular member.

10. The apparatus of claim 9, wherein:

the second portion is movable between a folded position and an unfolded position, the tubular member includes an aperture in a wall thereof, and the second tubular portion extends through the aperture of the tubular member when the second portion is in the unfolded position.

11. The apparatus of claim 8, wherein the portions each comprise expandable screen and the tubular member comprises steel pipe.

12. The apparatus of claim 8, wherein the first portion is substantially disposed around the tubular member.

13. The apparatus of claim 6, wherein the portions are joined to the junction with cement.

14. The apparatus of claim 6, wherein the second portion further comprises an expandable screen.

15. The apparatus of claim 6, wherein the second portion is folded and substantially contained within the first portion.

16. The apparatus of claim 6, further comprising a deflector having a cavity, wherein the second portion is folded and substantially contained within the cavity.

17. The apparatus of claim 16, further comprising:

a tubular member coupled to the first portion, wherein the deflector is disposed within the tubular member.

18. The apparatus of claim 17, further comprising:

an anchor disposed within the tubular member, the anchor axially and rotationally coupled to the deflector and axially and rotationally coupled to the tubular member.

19. A method of preparing a junction apparatus for installation in a junction between a central and an at least partially formed lateral wellbore, comprising:

providing the junction apparatus comprising:

a first tubular portion comprising a first wall with a first aperture therein; and a second tubular portion comprising a second wall and an end operatively connected to the first portion proximate to the aperture, wherein at least one of the walls includes perforations therethrough for filtering particulates; and folding the second portion so that it is substantially contained within the first portion.

20. The method claim 19, further comprising: running the junction apparatus through the central wellbore to the junction; and unfolding the second portion so that it extends into the at least partially formed lateral wellbore.

21. A method for lining a junction between a central wellbore and a lateral wellbore, comprising acts of:

running a tubular screen into the wellbore to a location proximate to the junction or an enlarged portion of the wellbore, the tubular screen comprising a central portion and a lateral portion, a substantial portion of the lateral portion folded into the central portion;

running an unfolding member into the central portion; and deflecting the unfolding member into the lateral portion, wherein the unfolding member will unfold the folded portion of the lateral portion as the unfolding member is deflected into the lateral portion.

22. The method of claim 21, wherein:

the central portion is coupled to a tubular member having a window formed through a wall thereof; and a deflector is disposed in the tubular member, the deflector having a cavity formed therein, the cavity located proximate to the window and housing the folded lateral portion.

23. The method of claim 22, wherein the act of running the tubular screen comprises running the tubular screen in on a run-in string, the run-in string comprising an expansion tool, an anchor, and a deflector.

24. The method of claim 23, wherein the run-in string further comprises a packer.

25. The method of claim 23, further comprising expanding a portion of the tubular member.

26. The method of claim 25, further comprising expanding a second portion of the tubular member.

27. The method of claim 22, wherein the unfolding member comprises a cone member.

28. The method of claim 22, wherein the unfolding member comprises a drill bit.

29. The method of claim 22, further comprising:

running in a string of tubulars and a second deflector member through the tubular member;

setting the deflector member;

running the string of tubulars along the deflector, through the window, and into the lateral wellbore.

30. The method of claim 21, wherein the unfolding member comprises a string of tubulars.

31. The method of claim 30, wherein the location is proximate to the junction and the method further comprises lining a substantial portion of the lateral wellbore with the tubular string.

32. The method of claim 30, wherein:

the location is proximate to the enlarged portion of the wellbore, a drill bit is housed within a lower end of the tubular string, the drill bit coupled to the lower end of the tubular string, and the method further comprises:

un-coupling the drill bit, axially moving the drill bit from within the lower end of the tubular string into a drilling position, and drilling the lateral wellbore.

33. The method of claim 32, further comprising expanding the drill bit.

34. A wellbore junction apparatus for a junction between a central and a lateral wellbore comprising:

a first tubular portion comprising a first wall with a first aperture therein;

a second tubular portion comprising a second wall and an end operatively connected to the first portion proximate to the aperture, wherein at least one of the walls includes perforations therethrough for filtering particulates; and a tubular member coupled to the first portion, wherein:

the first portion is substantially disposed within the tubular member, the second portion is movable between a folded position and an unfolded position, the tubular member includes an aperture in a wall thereof, and the second tubular portion extends through the aperture of the tubular member when the second portion is in the unfolded position.

35. A wellbore junction apparatus for a junction between a central and a lateral wellbore comprising:

a first tubular portion comprising a first wall with a first aperture therein; and a second tubular portion comprising a second wall and an end operatively connected to the first portion proximate to the aperture, wherein:

at least one of the walls includes perforations therethrough for filtering particulates, and the second portion is folded and substantially contained within the first portion.

36. A wellbore junction apparatus for a junction between a central and a lateral wellbore comprising:

a first tubular portion comprising a first wall with a first aperture therein;

a second tubular portion comprising a second wall and an end operatively connected to the first portion proximate to the aperture, wherein at least one of the walls includes perforations therethrough for filtering particulates; and a deflector having a cavity, wherein the second portion is folded and substantially contained within the cavity.

37. The apparatus of claim 36, further comprising:

a tubular member coupled to the first portion, wherein the deflector is disposed within the tubular member.

38. The apparatus of claim 37, further comprising:

an anchor disposed within the tubular member, the anchor axially and rotationally coupled to the deflector and axially and rotationally coupled to the tubular member.

39. A wellbore junction apparatus for a junction between a central and a lateral wellbore comprising:

a first tubular portion comprising a first wall with a first aperture therein;

a second tubular portion comprising a second wall and an end operatively connected to the first portion proximate to the aperture, wherein at least one of the walls includes perforations therethrough for filtering particulates; and a tubular member coupled to the first portion, wherein the portions each comprise expandable screen and the tubular member comprises steel pipe.

* * * * *